US006040016A

United States Patent [19]

Mitani et al.

[11] Patent Number: 6,040,016

[45] Date of Patent: Mar. 21, 2000

[54] LIQUID APPLICATION NOZZLE, METHOD OF MANUFACTURING SAME, LIQUID APPLICATION METHOD, LIQUID APPLICATION DEVICE, AND METHOD OF MANUFACTURING CATHODE-RAY TUBE

[75] Inventors: Masato Mitani, Hirakata; Kazuto Nakajima, Yamatokoriyama; Hiroyuki Kotani, Izumi; Nobutaka Hokazono, Neyagawa; Hiroyuki Naka, Osaka; Akira Yamaguchi, Hirakata; Junji Ikeda, Ikoma; Nobuyuki Aoki, Hirakata, all of Japan

[73] Assignees: Matsushita Electric Industrial Co., Ltd.; Matsushita Electronics Corporation, both of Osaka, Japan

[21] Appl. No.: 08/930,218

[22] PCT Filed: Feb. 20, 1997

[86] PCT No.: PCT/JP97/00462

§ 371 Date: Oct. 20, 1997

§ 102(e) Date: Oct. 20, 1997

[87] PCT Pub. No.: WO97/30793

PCT Pub. Date: Aug. 28, 1997

[30] Foreign Application Priority Data

Feb. 21, 1996 [JP] Japan ..... 8-033391
Oct. 14, 1996 [JP] Japan ..... 8-271104

[51] Int. Cl.[7] ..... B05D 1/02; B05B 7/06

[52] U.S. Cl. ..... 427/421; 427/420; 427/240; 427/346; 118/52; 118/313; 239/296; 239/299; 239/300; 239/424; 239/433

[58] Field of Search ..... 427/68, 72, 157, 427/420, 421, 240, 346; 118/52, 313, DIG. 4; 239/296, 299, 300, 423, 424, 424.5, 433, 589

[56] References Cited

U.S. PATENT DOCUMENTS

| | | | |
|---|---|---|---|
| 3,364,054 | 1/1968 | Weingarten | 427/72 |
| 3,876,465 | 4/1975 | Prazak, III | 117/33.5 C |
| 4,078,095 | 3/1978 | Ratay | 427/72 |
| 4,254,160 | 3/1981 | Raih | 427/57 |
| 4,746,588 | 5/1988 | Ditty et al. | 430/23 |
| 5,062,911 | 11/1991 | Hampton et al. | 156/89 |
| 5,423,935 | 6/1995 | Benecke et al. | 156/291 |
| 5,533,675 | 7/1996 | Benecke et al. . | |
| 5,731,044 | 3/1998 | Hirota et al. | 427/512 |

FOREIGN PATENT DOCUMENTS

| | | |
|---|---|---|
| 55-57230 | 4/1980 | Japan . |
| 59-186230 | 10/1984 | Japan . |
| 62-94545 | 6/1987 | Japan . |
| 3-122944 | 5/1991 | Japan . |
| 5-101775 | 4/1993 | Japan . |
| 6-170308 | 6/1994 | Japan . |

*Primary Examiner*—Shrive Beck
*Assistant Examiner*—Michael Barr
*Attorney, Agent, or Firm*—Wenderoth, Lind & Ponack, L.L.P.

[57] ABSTRACT

A liquid coating nozzle is provided with a first block which has an inner liquid reserving section that extends in the longitudinal direction and an inner discharge section which includes a plurality of small holes formed in the longitudinal direction at a bottom portion of the liquid reserving section. The nozzle is also provided with a second block which has an inner space defining a gas reserving section that extends in the longitudinal direction outside the first block and an outer discharge section formed in the longitudinal direction at a bottom portion of the inner space. The outer discharge section includes a plurality of small holes and produces a gas flow that externally surrounds a linear or curtain-shaped liquid flow that flows downward from the small holes. This results in the formation of a thin coating film in a short time and reduces the consumption of liquid and coating nonuniformities.

21 Claims, 17 Drawing Sheets

LIQUID APPLICATION NOZZLE, METHOD OF MANUFACTURING SAME, LIQUID APPLICATION METHOD, LIQUID APPLICATION DEVICE, AND METHOD OF MANUFACTURING CATHODE-RAY TUBE

TECHNICAL FIELD

The present invention relates to a liquid coating nozzle, method for manufacturing it, liquid coating method and liquid coating apparatus. The liquid coating apparatus forms a thin film by applying a coat of liquid on an object to be coated such as a cathode ray tube, a semiconductor substrate, a liquid crystal substrate, and a substrate for an optical disk. The present invention also relates to a method for manufacturing a cathode ray tube as an application of the above-mentioned nozzle.

Specifically, the present invention relates to a nozzle and a color CRT (cathode ray tube) capable of implementing a phosphor surface which has a coating pattern with a uniform quality at a higher level, and providing a high-luminance image.

BACKGROUND ART

For example, three kinds of phosphor picture elements for coloring in red, green, and blue are formed on a phosphor surface of a glass panel inner surface of a cathode ray tube. These picture elements are regularly arranged in a dot or strip manner via a photo-adsorption film which is called a black matrix. In a case where such phosphor picture elements are formed by coating, a liquid coating apparatus is used.

The manufacture of the phosphor surface will be described as follows. First, a photosensitive resin film is formed on a glass panel inner surface of a cathode ray tube. At positions for forming phosphor picture elements in a portion where the photosensitive resin film is formed, a phosphor forming section is manufactured through photoreactive material coating, exposure, and development. The photolithography technique is used for manufacturing the phosphor forming section. Next, a phosphor suspension (hereinbelow called a slurry) is coated on the panel inner surface. A phosphor forming section of a specific color is manufactured on request through the similar photolithography technique. The coating for forming the phosphor surface of the cathode ray tube is mainly carried out by rotary coating in which the slurry is coated on the panel while rotating the panel.

Such rotating coat is described below. First, a slurry in which a phosphor is suspended in a photosensitive resin is poured in the panel inner surface rotating at a lower speed. The poured slurry is gradually spread on the panel inner surface due to the inclination and rotation of the panel while the phosphor is precipitated. It is important to obtain a uniform coating film without coating nonuniformity in the phosphor coating process. For this purpose, there are already proposed a method of periodically changing the tilting angle of the panel in synchronization with the rotation period of the panel (for example, Japanese Unexamined Patent Publication No. 3-122944) and a method of carrying out the regular and reverse rotations of the panel (for example, Japanese Unexamined Patent Publication No. 5-101775).

Next, the panel is rotated at a higher speed to begin a superfluous liquid shaking-off process. In order to obtain a uniform coating film, it is important to set the tilting angle and the number of revolutions of the panel at the shaking-off operation. Then, there are already proposed a method of shaking-off the panel with the panel located upward diagonally (for example, Japanese Unexamined Patent Publication No. 55-57230) and a method of shaking-off the panel with the panel located downward diagonally (for example, Japanese Unexamined Patent Publication No. 59-186230).

In this process, a superfluous slurry is discharged outside of the panel. Next, the coating film is heated by an external infrared heater to dry it. Then, a shadow mask is set and subjected to exposure to ultraviolet light. The irradiation of the ultraviolet light allows a photo-crosslinking reaction to progress between a photosensitive resin and a photo-initiator while an exposed portion is insolubilized to water. After the exposure, the shadow mask is removed and a development is carried out by a hot water shower etc. to wash out an unexposed portion with water, thereby forming a phosphor pattern only at a required portion. Through the above processes, a phosphor surface of the cathode ray tube is completed.

On the other hand, in accordance with the change of Office Automation environment, requirements of a display for a cathode ray tube are variously changed from technical issues such as high fine accuracy, high luminance, and high contrast to ideal conditions of displays. Since it is difficult to see a screen of a cathode ray tube having a conventional curvature due to irregular reflection of external light, it has become increasingly necessary to make the configuration of the screen completely flat. Moreover, it is required to accomplish high luminance and high resolution at any portion in the central portion and in the peripheral portion of the cathode ray tube-use display due to the development of the Office Automation environment. In order to meet the requirement, as improved manners, for example, there is proposed a method in which during the forming of the phosphor surface, a slurry is linearly coated in a short time in a glass panel inner surface.

However, the above-described methods have the following issues.

(1) The conventional slurry coating methods require a slightly larger amount of the slurry in order to spread the slurry on the effective surface of the panel by adjusting the inclination and the number of revolutions of the panel. Therefore, an excessive amount of the slurry causes liquid spattering and inclusion of bubbles. There is a difference in film thickness due to the compulsive flow of the slurry from the central portion to the peripheral portion thereof by the inclination of the panel.

(2) In a case where a slurry is linearly coated, it is very difficult to coat, with a laminar flow, the panel with a coating liquid discharged from a coating nozzle. Therefore, for example, there is caused a sidewise spattering phenomenon in which the liquid is discharged in a direction perpendicular to the nozzle sweep direction, so that uncoated portions are left on the panel inner surface.

Thus, an object of the present invention is to provide a superior novel nozzle for discharging liquid downward in a linear or curtain shape, provide a method for efficiently manufacturing the novel nozzle with high accuracy and provide a liquid coating method and apparatus for using the novel nozzle.

Another object of the present invention is to provide a cathode ray tube manufacturing method capable of forming a film of uniform thickness at low cost in a short time while suppressing the consumption of the necessary liquid.

Another object of the present invention is to provide a liquid coating nozzle and a cathode ray tube manufacturing method in which, by using the coating nozzle for linearly discharging downward a liquid and optimizing the coating schedule of phosphor surface formation (phosphor screen process), a phosphor surface having a coating pattern with a uniform quality can be implemented at a higher level, and a high-luminance cathode ray tube can be supplied.

SUMMARY OF THE INVENTION

In order to accomplish the above object, the present invention is constructed as follows.

According to a first aspect of the present invention, there is provided a liquid coating nozzle for coating liquid on an object to be coated, comprising a first block and a second block.

The first block has an inner liquid reserving section that extends in its longitudinal direction and an inner discharge section formed in the longitudinal direction at a bottom portion of the liquid reserving section. The inner discharge section is comprised of a plurality of small holes or a slit.

The second block has an inner space defining a gas reserving section that extends in the longitudinal direction outside the first block and an outer discharge section formed in the longitudinal direction at a bottom portion of the inner space. The outer discharge section is comprised of a plurality of small holes or a slit and forms a gas flow that externally surrounds a linear or curtain-shaped liquid flow that flows downward from the inner discharge section.

According to a second aspect of the present invention, there is provided a liquid coating nozzle as defined in the first aspect, wherein the first block and the second block are each comprised of bisected bodies divided by a vertical plane that extends in the longitudinal direction through a widthwise center of the inner discharge section.

According to a third aspect of the present invention, there is provided a liquid coating nozzle as defined in the first or second aspect, wherein a shape of each of the small holes constituting each of the inner discharge section and the outer discharge section is an elongated hexagon.

According to a fourth aspect of the present invention, there is provided a liquid coating nozzle as defined in any of the first through third aspects, wherein the liquid reserving section has an inclined surface at a bottom of which the inner discharge section is positioned.

According to a fifth aspect of the present invention, there is provided a liquid coating nozzle as defined in any of the first through fourth aspects, wherein the gas reserving section has a sectional shape which is as large as possible so long as a required strength (or in other words, a strength required to maintain its structural integrity) is maintained.

According to a sixth aspect of the present invention, there is provided a liquid coating nozzle manufacturing method for manufacturing a nozzle for coating an object to be coated with liquid. The nozzle includes a first block which has an inner liquid reserving section that extends in its longitudinal direction and an inner discharge section formed in the longitudinal direction at a bottom portion of the liquid reserving section. The inner discharge section is comprised of a plurality of small holes or a slit. The nozzle further includes a second block which has an inner space defining a gas reserving section that extends in the longitudinal direction outside the first block and an outer discharge section formed in the longitudinal direction at a bottom portion of the inner space. The outer discharge section is comprised of a plurality of small holes or a slit and forms a gas flow that externally surrounds a linear or curtain-shaped liquid flow that flows downward from the inner discharge section. Furthermore, the first block and the second block are each comprised of bisected bodies divided by a vertical plane that extends in the longitudinal direction through a widthwise center of the inner discharge section. Also, the inner discharge section and/or the outer discharge section is comprised of a plurality of small holes.

The method includes positioning two bisected bodies which have been preparatorily processed with a groove-shaped space that serves as the liquid reserving section and/or the gas reserving section so that an opening plane of the groove-shaped space defines an identical plane (the plane at the opening of one body is identical to the plane at the opening of the other body).

Next, the method includes concurrently cutting small grooves constituting the small holes of both the bisected bodies, hence forming the small holes.

According to a seventh aspect of the present invention, there is provided a liquid coating method for coating liquid on an object to be coated by a liquid coating nozzle.

The method includes using the nozzle as defined in any of the first through fifth aspects, making the outer discharge section face the object to be coated and then discharging the liquid flow in a linear or curtain-like shape while discharging the gas flow toward the object to be coated through the outer discharge section.

Next, the method includes moving the object to be coated and the nozzle relatively to each other in a direction which intersects the longitudinal direction while discharging the liquid.

According to an eighth aspect of the present invention, there is provided a liquid coating method for coating liquid on an object to be coated by a liquid coating nozzle similar to the seventh aspect.

The method includes discharging a superfluous liquid from the object to be coated by tilting and rotating the object to be coated after the object to be coated and the nozzle are moved relative to each other.

Next, the method includes drying the liquid coated on the object to be coated.

According to a ninth aspect of the present invention, there is provided a liquid coating apparatus for coating liquid on an object to be coated.

The apparatus includes the nozzle defined in any of the first through fifth aspects.

The apparatus also includes a relative movement device for moving at least one of the nozzle and the object to be coated, which is facing the nozzle, in a direction which intersects the longitudinal direction.

According to a tenth aspect of the present invention, there is provided a liquid coating apparatus similar to the ninth aspect.

The apparatus includes a liquid circulating passage for supplying in a circulating manner the liquid to the liquid reserving section.

The apparatus also includes an opening and closing member for opening and closing the liquid circulating passage.

According to an eleventh aspect of the present invention, there is provided a liquid coating apparatus similar to the ninth or tenth aspect.

The apparatus includes a rotating mechanism and a tilting mechanism for discharging a superfluous liquid from the object to be coated by tilting and rotating the object to be coated—after the object to be coated and the nozzle are moved relative to each other by the relative movement device.

The apparatus also includes a drying device for drying the liquid coated on the object to be coated.

According to a twelfth aspect of the present invention, there is provided a liquid coating nozzle in which a plurality of discharge holes are arranged linearly. Furthermore, the discharge hole has a length D in a nozzle sweep direction and a liquid guiding section inside the nozzle has a length L. In addition, a relation of $1<L/D\leqq 10$ is held.

According to a thirteenth aspect of the present invention, there is provided a liquid coating nozzle as defined in the twelfth aspect, wherein the length D of the discharge hole in the nozzle sweep direction is larger than the length d thereof in the direction perpendicular to the nozzle sweep direction.

According to a fourteenth aspect of the present invention, there is provided a liquid coating nozzle as defined in the twelfth or thirteenth aspect, wherein the discharge hole has the length D in the nozzle sweep direction and the liquid guiding section inside the nozzle has the length L, and a relation of $3\leqq L/D\leqq 8$ is held.

According to a fifteenth aspect of the present invention, there is provided a cathode ray tube manufacturing method for coating or dispensing coating materials for a phosphor screen process on a glass panel by using a liquid coating nozzle in which a plurality of discharge holes are arranged linearly. Also, the discharge hole has a length D in a nozzle sweep direction and a liquid guiding section inside the nozzle has a length L, and a relation of $1<L/D\leqq 10$ is held.

The method comprises sweeping the coating nozzle either in a direction of a shorter side or in a direction of a longer side of the glass panel.

Thus, the method linearly coats the coating materials for the phosphor screen process on a phosphor screen-forming area of the glass panel.

According to a sixteenth aspect of the present invention, there is provided a cathode ray tube manufacturing method as defined in the fifteenth aspect, wherein a front surface of the glass panel is arranged substantially parallel to a horizontal plane when being coated.

According to a seventeenth aspect of the present invention, there is provided a cathode ray tube manufacturing method similar to the fifteenth or sixteenth aspect.

The method includes spreading the coating materials for the phosphor screen process on an entire surface of the screen area of the glass panel while making the glass panel have a glass panel rotating speed of 30 to 60 rpm after the coating.

Next, the method includes discharging a superfluous coating materials for the phosphor screen process by setting the glass panel rotating speed at 50 to 150 rpm and by setting a glass panel tilt angle θ at 95 to 115 degrees relative to the horizontal axis.

The method also includes drying a phosphor film formed by the coating liquid by setting the glass panel rotating speed at 10 to 150 rpm.

According to an eighteenth aspect of the present invention, there is provided a cathode ray tube manufacturing method as defined in any one of the fifteenth through seventeenth aspects, wherein the screen area of the glass panel has a completely flat shape.

According to a nineteenth aspect of the present invention, there is provided a cathode ray tube manufacturing method as defined in any one of the fifteenth through eighteenth aspects, wherein a nozzle has a length D of the discharge hole in the nozzle sweep direction which is larger than the length d thereof in the direction perpendicular to the nozzle sweep direction.

According to a twentieth aspect of the present invention, there is provided a cathode ray tube manufacturing method as defined in any one of the fifteenth through nineteenth aspects, wherein a nozzle has a discharge hole with a length D in the nozzle sweep direction and the liquid guiding section inside the nozzle has the length L, and a relation of $3\leqq L/D\leqq 8$ is held.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE INVENTION

Figure 1:
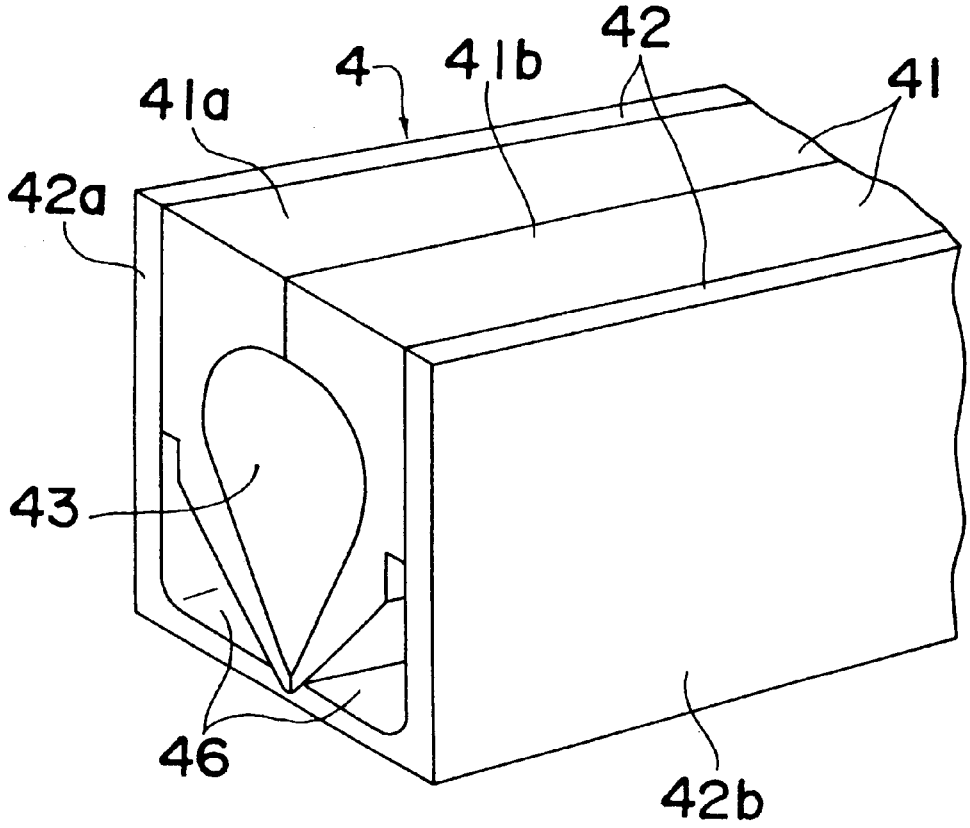
FIG. 1 is a perspective view showing the construction of a liquid coating nozzle of a first embodiment of the present invention.

Before the description of the present invention proceeds, it is to be noted that like parts are designated by like reference numerals throughout the accompanying drawings.

First, embodiments of the present invention will be described schematically.

According to a liquid coating nozzle of an embodiment of the present invention, a liquid in the liquid reserving section is discharged from the inner discharge section, and a gas in the gas reserving section is discharged from the outer discharge section, thereby forming a gas flow that externally surrounds a linear or curtain-shaped liquid flow that flows downward from the inner discharge section. Therefore, the liquid flow flows straightly downward without deviating in the moving direction of the nozzle to reach the surface of the object to be coated without nonuniformity. When the inner discharge section and the outer discharge section are comprised of small holes, a gas flow that cylindrically surrounds the linear liquid flow is formed, and therefore, the liquid flow easily flows straightly downward without deviating in the moving direction or in lateral direction of the nozzle.

According to a liquid coating nozzle of another embodiment of the present invention, the shape of each of the small holes constituting the inner discharge section and the outer discharge section is an elongated hexagon. Therefore, each of the liquid flow and the gas flow flows downward as a turning flow, so that they hardly deviate sideways.

According to a liquid coating nozzle of another embodiment of the present invention, the liquid reserving section has inclined surfaces at the bottom of which the inner discharge section is positioned. Therefore, in the liquid reserving section, the liquid falls sliding along its inclined surfaces and is discharged from the inner discharge section. Therefore, even when the liquid contains particles of a pigment or the like, precipitated particles fall along the inclined surfaces and do not stay in the liquid reserving section.

According to a liquid coating nozzle of another embodiment of the present invention, the sectional shape of the gas reserving section is made as large as possible so long as a required strength is maintained. Therefore, the strength of the first block is assured and the gas pressure difference in the liquid reserving section between the one side and the other side in the longitudinal direction is reduced, so that the discharge of the gas from the outer discharge section is stabilized.

A liquid coating nozzle manufacturing method of another embodiment of the present invention, is the method for manufacturing the nozzle of the embodiments. In this method, the first block and the second block are each comprised of bisected bodies divided by a vertical plane that expands in the longitudinal direction through the widthwise center of the inner discharge section. The inner discharge section and/or the outer discharge section is comprised of a number of small holes, whereby processing of the small holes is performed by positioning two bisected bodies which have been preparatorily processed with a groove-shaped space that serves as the liquid reserving section and/or the gas reserving section so that the opening plane of the groove-shaped space defines an identical plane (in other words, the openings are identical) while concurrently cutting the small grooves for constituting the small holes of both the bisected bodies. Therefore, when the two bisected bodies are coupled with each other to form the first block and the second block, the small grooves of the bisected bodies fit tightly to each other, thereby forming the small holes.

According to the liquid coating method and the liquid coating apparatus of an embodiment of the present invention, the outer discharge section of the nozzle of the embodiments is made or positioned to face the object to be coated. At least one of the object to be coated and the nozzle is made to move relative to the other in the direction that intersects the longitudinal direction when the liquid flow is discharged in a linear or curtain-like shape while discharging the gas flow toward the object to be coated through the outer discharge section. Therefore, by adjusting the amount of discharge of the liquid, a uniform thin coating film having reduced coating nonuniformity can be formed in a short time while suppressing the consumption of the liquid.

According to the liquid coating method and the liquid coating apparatus of an embodiment of the present invention, the discharge section of the nozzle of the embodiments is made to face or positioned the object to be coated. At least one of the object to be coated and the nozzle is moved relative to the other in the direction that intersects the longitudinal direction when the liquid flow is discharged in a linear or curtain-like shape toward the object to be coated through the discharge section. Therefore, by adjusting the amount of discharge of the liquid, a uniform thin coating film having reduced coating nonuniformity can be formed in a short time while suppressing the consumption of the liquid.

The liquid coating apparatus of an embodiment of the present invention is provided with a liquid circulating passage for supplying in a circulating manner the liquid to the liquid reserving section as well as to an opening and closing member for opening and closing the liquid circulating passage. With this arrangement, the circulation of the liquid can be effected or stopped. Therefore, the circulation of the liquid can be stopped while the liquid is being discharged thereby allowing the pressure to be stabilized. Also, the circulation of the liquid can be effected while the discharging of the liquid is stopped thereby preventing the precipitation of the particles.

Hereinbelow, the above embodiments are explained in detail with reference to the drawings.

(First Embodiment)

Figure 2:
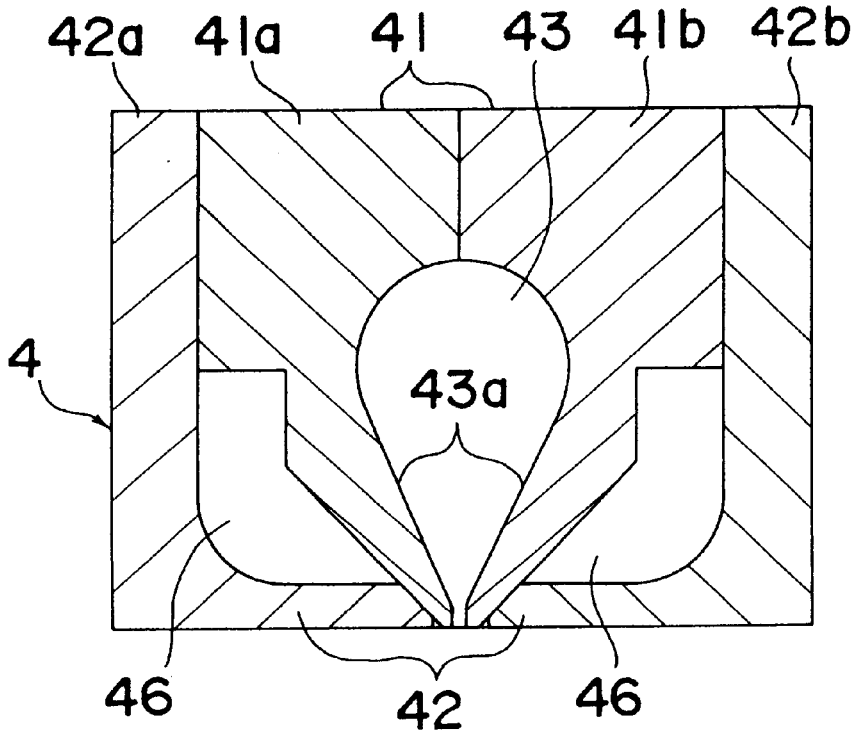
FIG. 2 is a sectional view of the nozzle of the first embodiment.

FIG. 1 is a perspective view showing a part of a liquid coating nozzle according to a first embodiment of the present invention, while FIG. 2 is a sectional view of it.

In FIG. 1, a liquid coating nozzle 4 is provided with a first block 41 and a second block 42.

The first block 41 is an elongated thing having an approximately T-like sectional shape (FIG. 2). The first block has a tapered longitudinal end and is internally provided with a liquid reserving section 43 that extends in the lengthwise direction. The liquid reserving section 43 is formed into a large tunnel that extends in the lengthwise direction of a nozzle 4. At a bottom portion (at a longitudinal end portion of the letter T) of the liquid reserving section 43 is formed an inner discharge section comprised of a number of small holes 44 in the lengthwise direction of the first block 41 as shown also in FIGS. 4 and 5.

The length of the line of the small holes 44 can be made sufficiently longer than the longitudinal or lateral direction of a glass panel section (not shown) of the maximum size of the object to be coated, the length being able to be, for example, 600 mm or 1000 mm.

Figure 3:
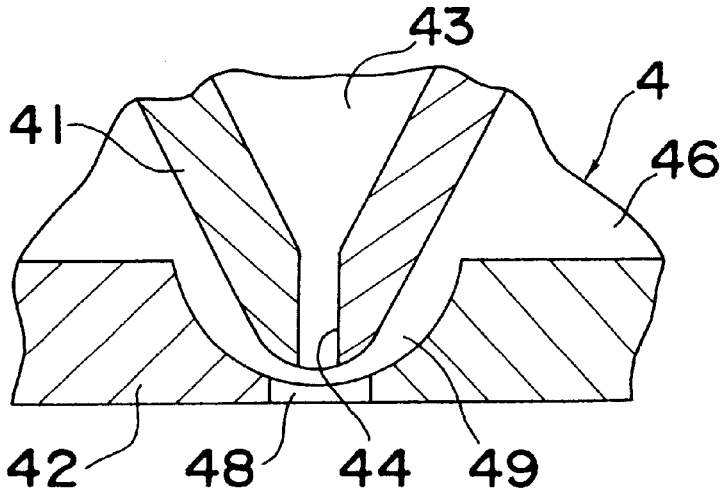
FIG. 3 is an enlarged transverse sectional view of a part of the nozzle of the first embodiment.

The second block 42 is an elongated thing having an approximately U-like sectional shape (FIG. 2), and it fits tightly to the lateral end surfaces of the first block 41 so as not to allow gas to pass and has an inner space that forms a gas reserving section 46 outside the first block 41. As shown also in FIGS. 3 through 5, an outer discharge section comprised of a number of small holes 48 formed in positions just below the small holes 44 is formed in the lengthwise direction of the second block 42 at a bottom portion of the inner space.

When the small holes 48 are made larger than the small holes 44, a liquid flow discharged from the small hole 44 easily passes through the small hole 48.

The small holes 44 and 48 can each be formed into a variety of shapes including, for example, a round hole, an ellipse hole, a polygonal hole, a star-shaped hole or an irregularly shaped hole. Taking into to account the point that each of the discharged liquid flow and gas flow tends to be a turning flow, each small hole may preferably be a hexagonal hole, and more preferably be an elongated hole, and even more preferably be an elongated hexagonal hole. In the case of an elongated small hole, the ratio (or in other words, the ratio in the widthwise direction (shorter diameter) of the small hole to the longer diameter of the small hole) of each small hole in the lengthwise direction is, for example, $1/1.5$ to $1/3$ and more preferably $1/1.5$ to $1/2$. When the lengthwise direction of the elongated small hole coincides with the lengthwise direction of the nozzle, the processing accuracy of the small hole can be easily increased (particularly in the case of a block comprised of bisected bodies).

The distance between each of the small holes 44 and 48 is, for example, about 0.5 to 8 mm in terms of a distance between the centers of adjacent small holes. Taking into account the point that the discharged liquid reaches the surface of the object to be coated and flows sideways to uniformly coat the object as the liquid from one hole merges with the liquid discharged from the adjacent holes, the size is preferably 0.5 mm to 1 mm. The objects of the invention can be achieved by forming 600 small holes 44 and 48 at a distance of 1 mm between the centers of adjacent small holes 44 and making them correspond to a glass panel section of 600 mm or by forming 1,000 small holes and making them correspond to a glass panel section of 1,000 mm. It is to be noted that, even though the distance between the centers of the small holes 44 and 48 is constant the interval between the liquids discharged linearly can be arbitrarily adjusted by changing the angle of inclination. This is accomplished by arranging the nozzle 4 so that the lengthwise direction of the nozzle 4 is inclined with respect to the longitudinal direction or the lateral direction of the object to be coated and moving the nozzle 4 in parallel with the longitudinal direction or the lateral direction of the object to be coated in this state.

The first block 41 is comprised of bisected bodies 41*a* and 41*b* divided by a vertical plane that extends in the lengthwise direction through the widthwise centers of the small holes 44 which serve as the inner discharge section. The second block 42 is also comprised of bisected bodies 42*a* and 42*b* divided by a vertical plane that extends in the lengthwise direction through the widthwise centers of the small holes 48.

The liquid reserving section 43 has inclined surfaces 43*a* at the bottom of which is positioned the small hole 44. This inclined surface 43*a* preferably has a greater inclination with respect to the plane perpendicular to the vertical plane or in other words, the inclined surfaces are closer to vertical, so that the liquid inside easily flows down to the small holes 44. Furthermore, in order to prevent the occurrence of a difference in the amount of discharge of liquid between one end side and the other end side of the liquid reserving section 43, it is preferable to make the sectional area as great as possible. In order to make the sectional area of the liquid reserving section 43 as great as possible, the inclined surface 43*a* preferably has a steep inclination. Taking into account the arrangement that the liquid easily flows downward along the inclined surface 43*a* and the arrangement that the sectional area of the liquid reserving section 43 is made as great as possible, the inclined surface 43*a* preferably has an angle of not smaller than 75 degrees and not greater than 90 degrees with respect to the plane perpendicular to the vertical plane.

In order to prevent the occurrence of the difference in the amount of discharge of gas between one end side and the other end side of the gas reserving section 46, it is preferable to make the sectional area of the gas reserving section 46 as great as possible.

Furthermore, in order to make the sectional area of the gas reserving section 46 as great as possible, it is preferable to make the thickness of the first block 41 and the second block 42 as thin as possible. It is to be noted that, as the thickness of the first block 41 and the second block 42 is made thinner, the first block 41 and the second block 42 may swell or shrink thereby varying the sectional area of the liquid reserving section 43 or the gas reserving section 46 or varying the widths of the small holes 44 and 48, resulting in changing the amount of discharge. In order to prevent such a variation, it is preferable to maintain the required strength of the first block 41 and the second block 42. Taking into account that the sectional area of the gas reserving section 46 is to be made as great as possible and that the strength of the first block 41 and the second block 42 is to be maintained, the sectional shape of the gas reserving section 46 is preferably made as great as possible so long as the required strength is maintained. When the surface of the gas reserving section 46 on the first block side is an inclined surface less steep than the inclined surface 43*a* rather than being parallel to the inclined surface 43*a* of the liquid reserving section 43, the portion having a great thickness has a reinforcing effect, allowing the required strength to be maintained.

It is acceptable to provide a gas passage 49 between the gas reserving section 46 and the small holes 48, thereby allowing a gas flow to be rectified or merged into a layer flow.

Figure 6:
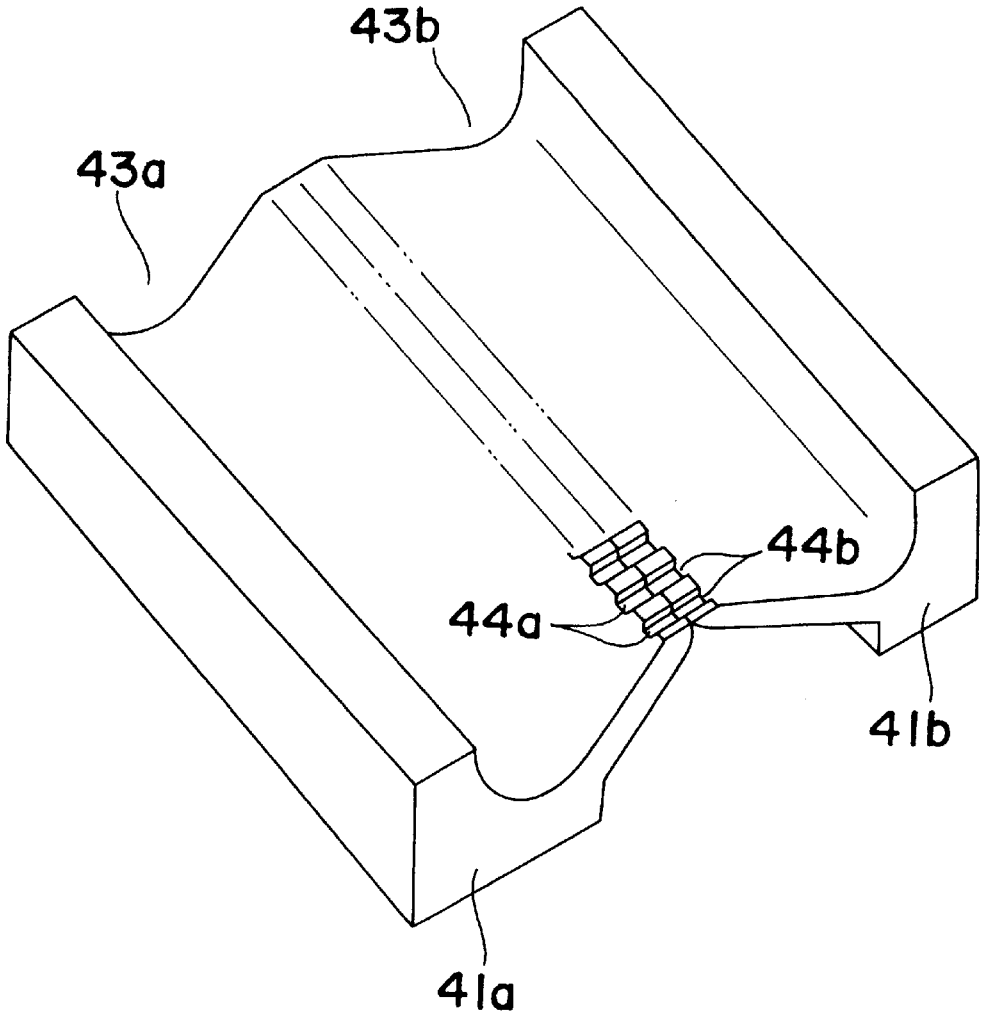
FIG. 6 is a perspective view showing a stage in which a first block is manufactured.
Figure 8:
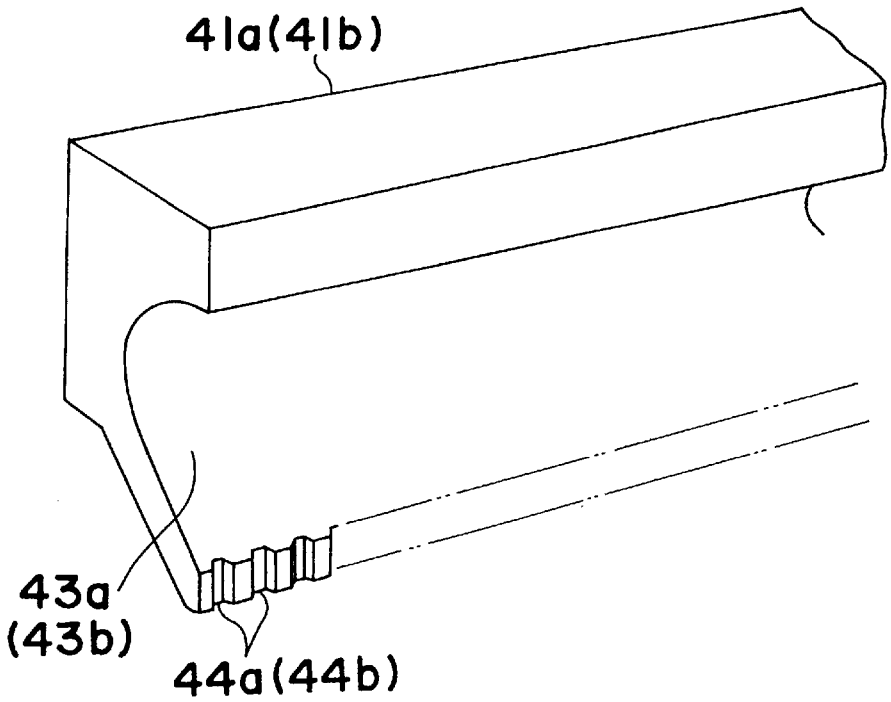
FIG. 8 is a perspective view of a disassembled portion of the first embodiment.

It is proper to perform the processing or forming of the small holes 44 of the first block 41 comprised of the bisected bodies 41*a* and 41*b*, for example, in a manner as follows to obtain sufficient accuracy and efficiency. As shown in FIG. 6, by positioning the two bisected bodies 41*a* and 41*b* that have been processed or formed with the groove-like spaces 43*a* and 43*b* which will serve as the liquid reserving section so that the opening planes of the groove-like spaces 43*a* and 43*b* form an identical plane concurrently cutting small grooves 44*a* and 44*b* for constituting the small holes 44 on both the bisected bodies 41*a* and 41*b*, the divided bodies 41*a* and 41*b* as shown in FIG. 8 are obtained.

Figure 7:
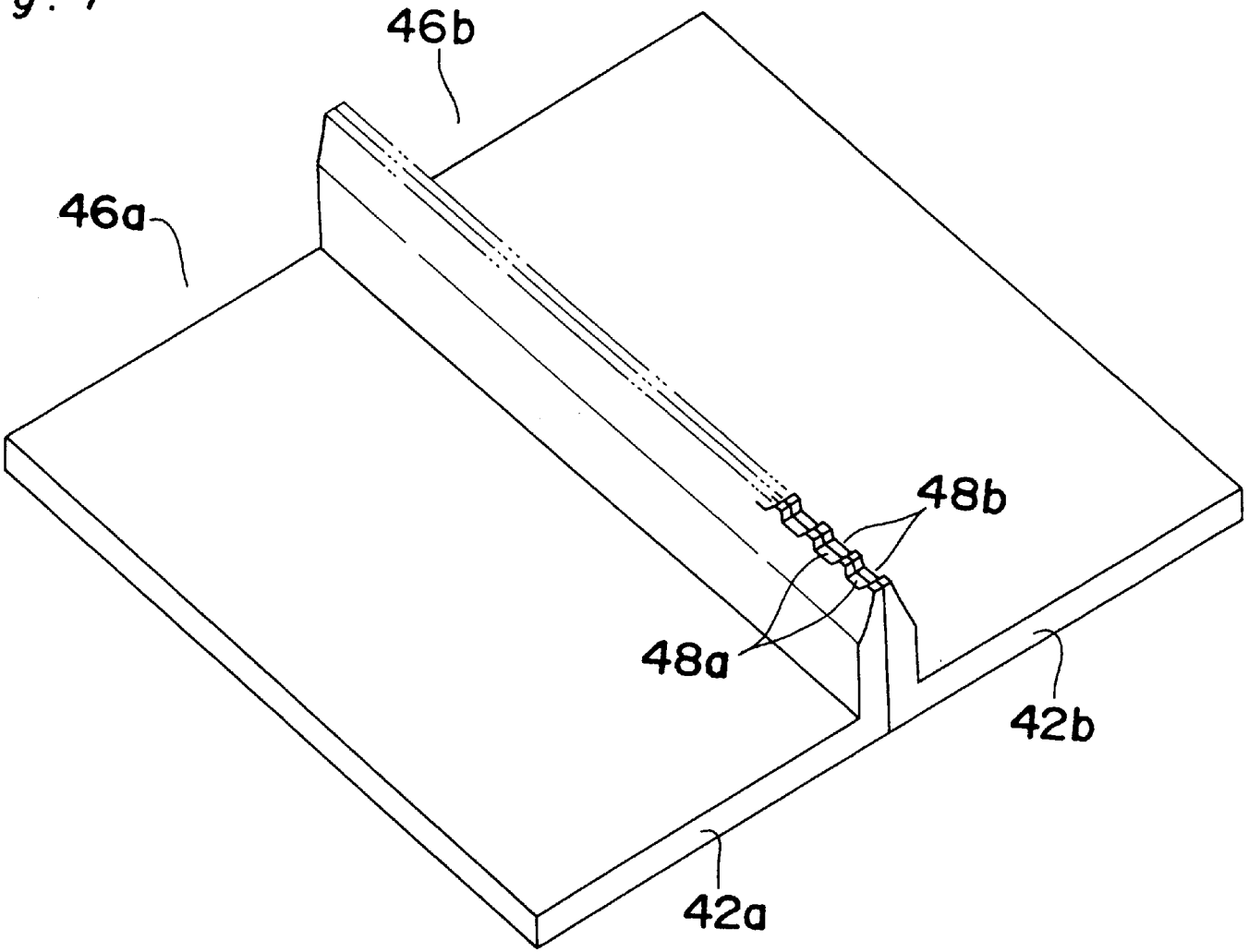
FIG. 7 is a perspective view showing a stage in which a second block of the nozzle of the first embodiment is manufactured.
Figure 9:
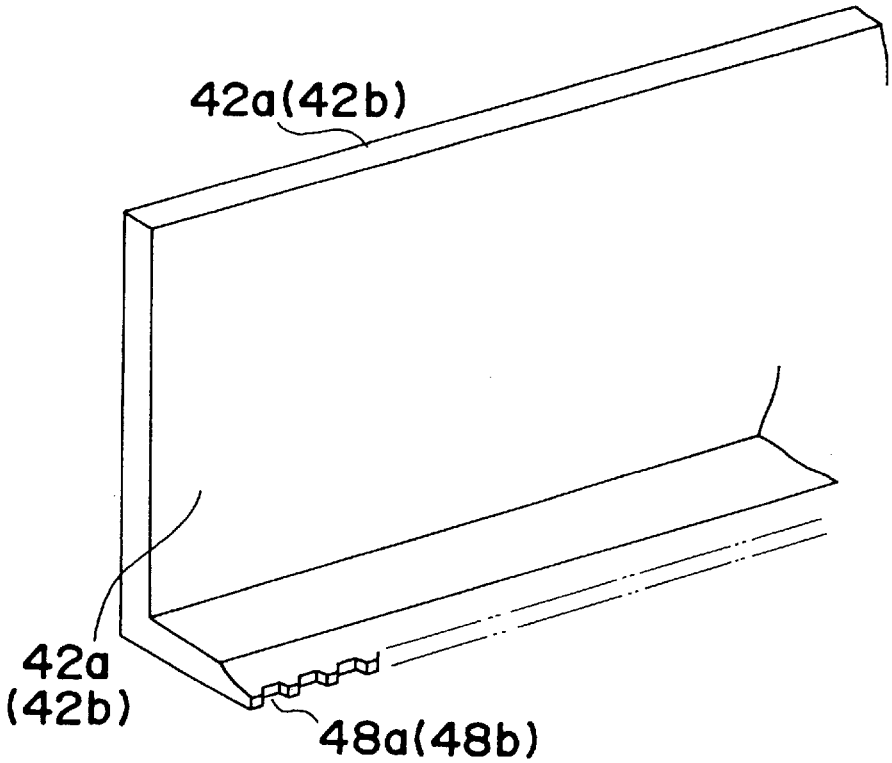
FIG. 9 is a perspective view of a disassembled portion of the first embodiment.

It is proper to perform the processing of the small holes 48 of the second block 42 comprised of the bisected bodies 42*a* and 42*b*, for example, in a manner as follows to obtain sufficient accuracy and efficiency. As shown in FIG. 7, by positioning the two bisected bodies 42*a* and 42*b* that have been processed or formed with the groove-like spaces 46*a* and 46*b* which will serve as the gas reserving section 46 so that the opening planes of the groove-like spaces 46*a* and 46*b* form an identical plane while concurrently cutting small grooves 48*a* and 48*b* for constituting the small holes 48 on both the bisected bodies 42*a* and 42*b*, the divided bodies 42*a* and 42*b* as shown in FIG. 9 are obtained.

Figure 10:
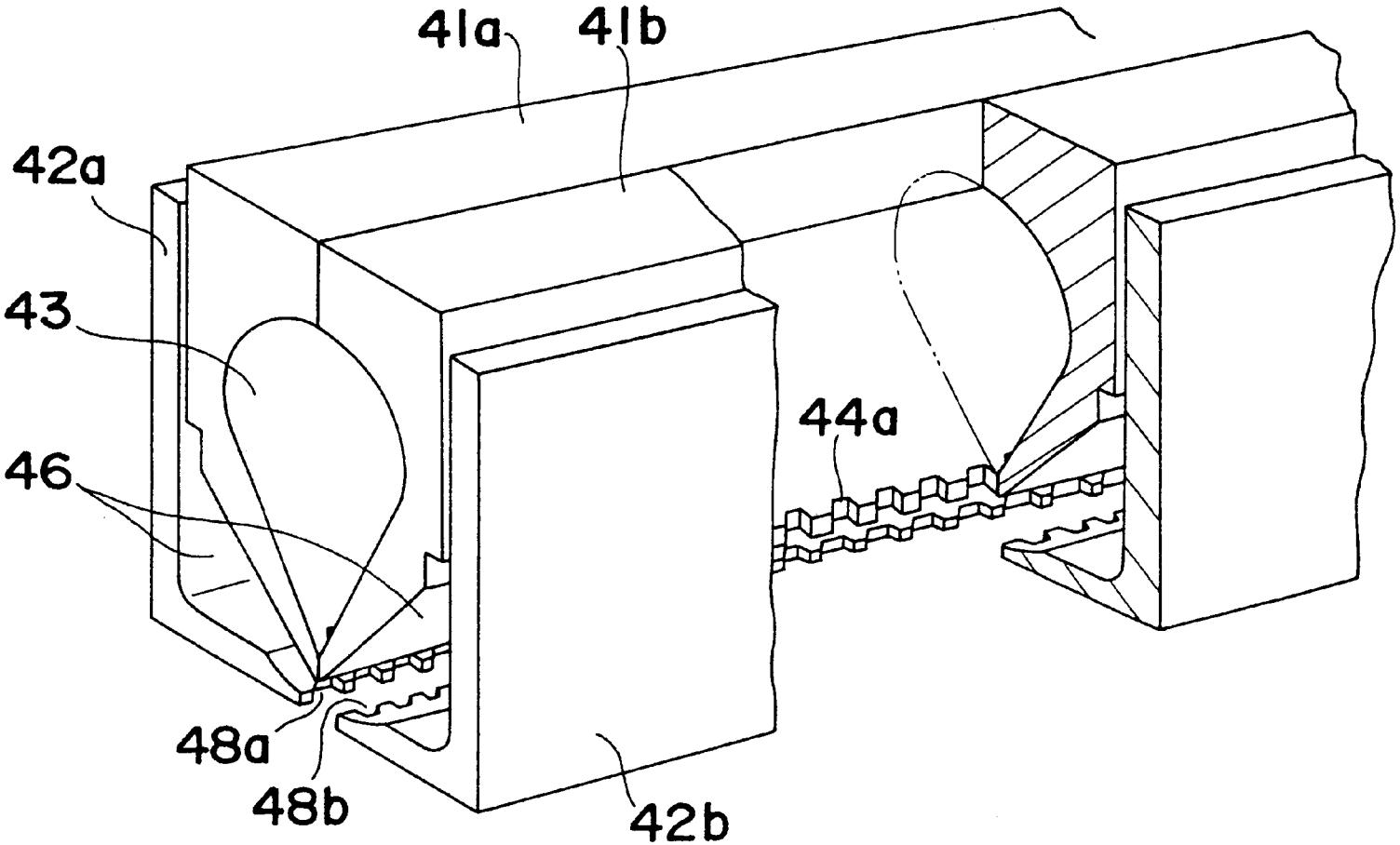
FIG. 10 is a perspective view of the nozzle of the first embodiment with a part removed and illustrated in cross section.

By assembling the thus-produced divided bodies 41*a*, 41*b*, 42*a* and 42*b* in a manner as shown in FIG. 10 and fixing the divided bodies 41*a*, 41*b*, 42*a* and 42*b* in the assembled state with metal fittings (not shown) with interposition of packings (not shown) at both end portions, the nozzle 4 shown in FIGS. 1 through 5 is obtained.

(Second Embodiment)

Figure 11:
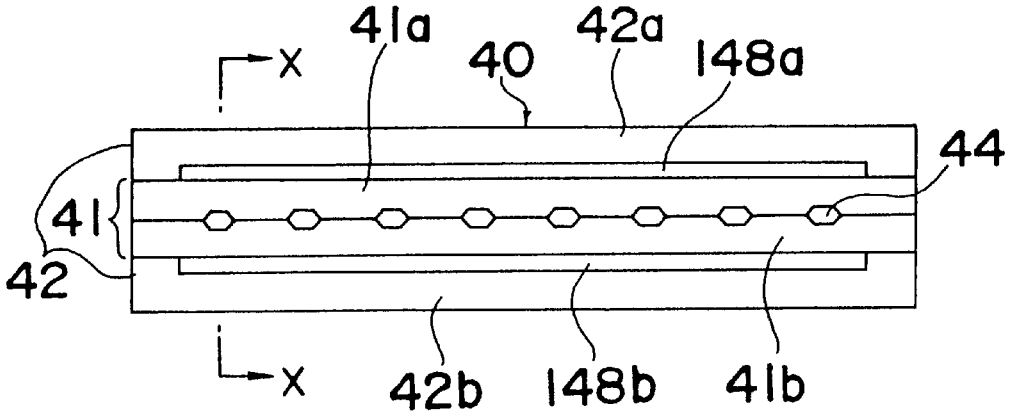
FIG. 11 is a bottom view of a nozzle of a second embodiment of the present invention.
Figure 12:
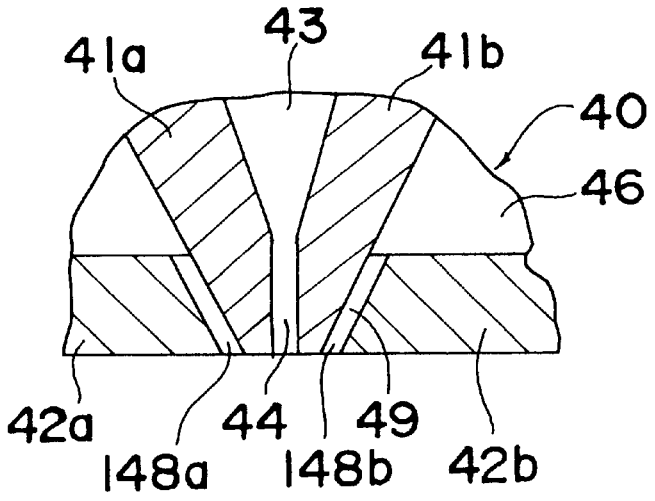
FIG. 12 is an enlarged sectional view of a portion X—X of the second embodiment.

FIG. 11 is a bottom view showing a liquid coating nozzle according to a second embodiment of the present invention, while FIG. 12 is an enlarged view of a sectional portion X—X of FIG. 11. In FIGS. 11 and 12, a liquid coating nozzle 40 is equivalent to the liquid coating nozzle 4 of the first embodiment except for the difference in the following point.

In this nozzle 40, the inner discharge section is comprised of a number of small holes 44, while the outer discharge section is comprised of two parallel slits 148*a* and 148*b* arranged on both sides of the line of the small holes 44. The longitudinal end surface of the first block 41 is positioned so that it forms a surface approximately identical to or flush with the lower surface of the second block 42. The small holes 44 are comprised of a number of small holes having the same shape and size as those of the first embodiment, however, the length is longer and they are not in communication with the gas reserving section 46. The second block 42 is an elongated thing having an approximately L-like sectional shape (not shown in FIGS. 11 and 12) and has a wide groove constituting the slits 148*a* and 148*b* at its longitudinal end, thereby constituting the slits 148*a* and 148*b* which fit tightly to the longitudinal end side surface of the first block 41.

In the nozzle of this embodiment, a linear liquid flow flows downward from the inner discharge section, and a curtain-shaped gas flow flows downward from the outer discharge section.

(Third Embodiment)

Figure 13:
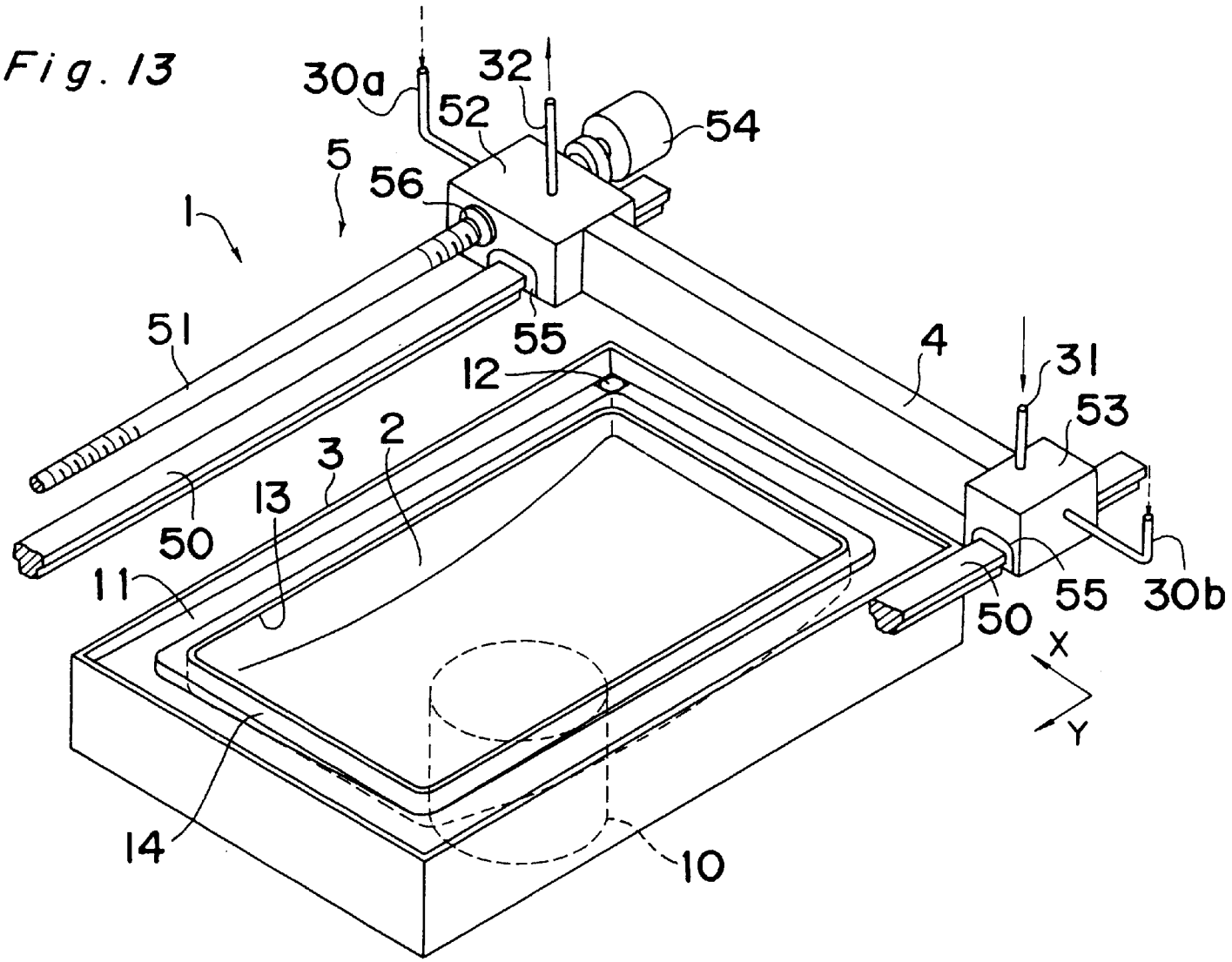
FIG. 13 is a perspective view showing the construction of a liquid coating apparatus of a third embodiment of the present invention.

FIG. 13 is a perspective view showing a liquid according to a third embodiment of the present invention.

In FIG. 13, a liquid coating apparatus 1 is provided with: a tube support section 3 which rotatably supports a glass panel section 2 of a laterally elongated cathode ray tube having an aspect ratio of, for example, 16:9; the nozzle 4 of the first embodiment which is elongated in an X-direction (in the moving direction of the sheet) in which a phosphor suspension is discharged onto the glass panel section 2; and a nozzle moving section 5 for moving the nozzle 4 in a Y-direction perpendicular to the X-direction on the tube support section 3.

The tube support section 3 is a box-shaped member, of which lower surface is mounted with a rotational drive section 10 including a motor. It is to be noted that the tube support section 3, conforming in size to the glass panel section 2 of the cathode ray tube, is prepared and removably mounted to the rotational drive section 10. Around the upper surface of the tube support section 3 is formed a drain groove 11 having a slope for draining out superfluous liquid. In the lowest position of the drain groove 11 is provided an outlet 12 through which the superfluous liquid is discharged to the outside to be reused. At a center portion of the tube support section 3 is formed an approximately rectangular mounting opening 13 for mounting the glass panel section 2. The mounting opening 13 has a shape conforming to the periphery of the glass panel section 2 and is internally provided with a sealing member 14 for preventing the liquid from leaking.

The nozzle 4 has on its lower surface the small holes 44 and 48 which serve as the inner and outer discharge sections arranged in the X-direction. The length of the line of the small holes 44 and 48 is sufficiently longer than the length in the X-direction of the glass panel section 2 of the maximum size of the object to be coated.

Figure 14:
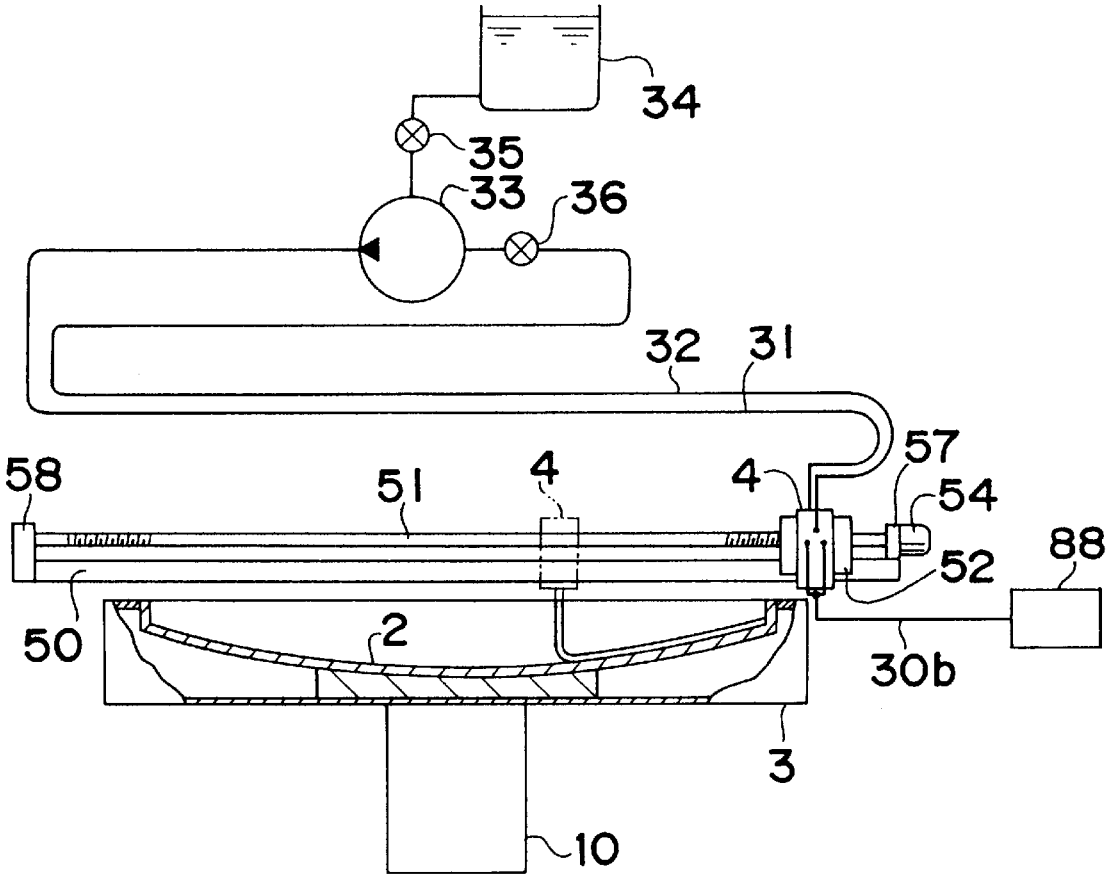
FIG. 14 is a side view of the third embodiment with a part illustrated in cross section.

As shown in FIGS. 13 and 14, the nozzle moving section 5 has a pair of guide rails 50 which are arranged on both sides of the tube support section 3 and extended in the Y-direction, a ball thread shaft 51 which is rotatably arranged along the guide rail 50 on the depthwise side in FIG. 13, and a driving frame 52 and a driven frame 53 which are fixed with interposition of packings and fixing metal fittings (not shown) at both ends of the nozzle 4. The ball thread shaft 51 is rotatably supported at both ends by bearings 57 and 58, and a driving motor 54 is connected to an end portion of a side of the bearing 57. The driving frame 52 is provided with a linear bearing 55 guided by the guide rail 50 and a ball nut 56 to be meshed with the ball thread shaft 51. The driven frame 53 is provided with a linear bearing 55 guided by the guide rail 50.

As shown in FIGS. 13 and 14, the driving frame 52 and the driven frame 53 are provided with two air inlets (not shown) for introducing air into the gas reserving section 46 inside the nozzle 4 and a pair of liquid inlet and liquid outlet (not shown) for introducing and discharging liquid into and from the liquid reserving section 43 while circulating the liquid. To the air inlets are connected air hoses 30*a* and 30*b* via connecting metal fittings. The air hoses 30*a* and 30*b* are connected to an air pressure source 88 as shown in FIG. 14. To the liquid inlet and outlet are connected circulation hoses 31 and 32 via connecting metal fittings. As shown in FIG. 14, the circulation hose 31 is connected to the outlet side of a circulation pump 33 comprised of a gear pump. The circulation hose 32 is connected to the inlet side of the circulation pump 33 via a valve 36. To the inlet side of the circulation pump 33 is also connected a tank 34 for reserving the phosphor suspension via a valve 35. In this case, the circulation of the liquid is to prevent the phosphor in the liquid located in the pipes, hoses and the nozzle 4 from precipitating in the liquid in the stage of liquid supply stop. In the stage of liquid supply stop, the valve 35 is closed and the valve 36 is opened to circulate the liquid through the circulation hoses 31 and 32, thereby preventing the precipitation of the phosphor.

The air inlets of the driving frame 52 and the driven frame 53 are connected to the gas reserving section 46 of the nozzle 4 which is a space elongated in the X-direction. The gas reserving section 46 is communicated with the small holes 48 which serves as the outer discharge section through the gas passage 49 at the bottom portion of the second block 42 of the nozzle 4. The gas passage 49 is a very thin space having a width slightly longer than that of the line of the small holes 44 and 48, and it is able to rectify or direct air into a layer flow. The air which has passed through this space is substantially formed into air of a layer flow. The liquid inlet and liquid outlet are communicated with the liquid reserving section 43 which is a space elongated in the X-direction. The liquid reserving section 43 has a very large capacity with respect to the flow rate, and the liquid reserved there is made to be not discharged under a normal pressure. The liquid reserving section 43 is communicated with the small holes 44 at the bottom portion and communicated with the small holes 48 at the exit of the gas passage 49.

Figure 4:
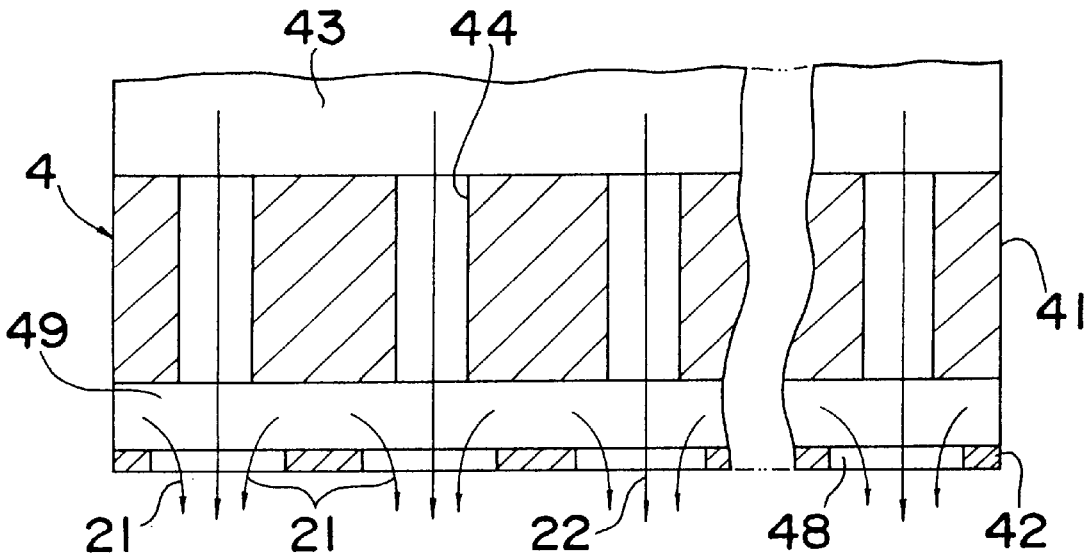
FIG. 4 is an enlarged longitudinal sectional view of a part of the nozzle of the first embodiment.
Figure 5:
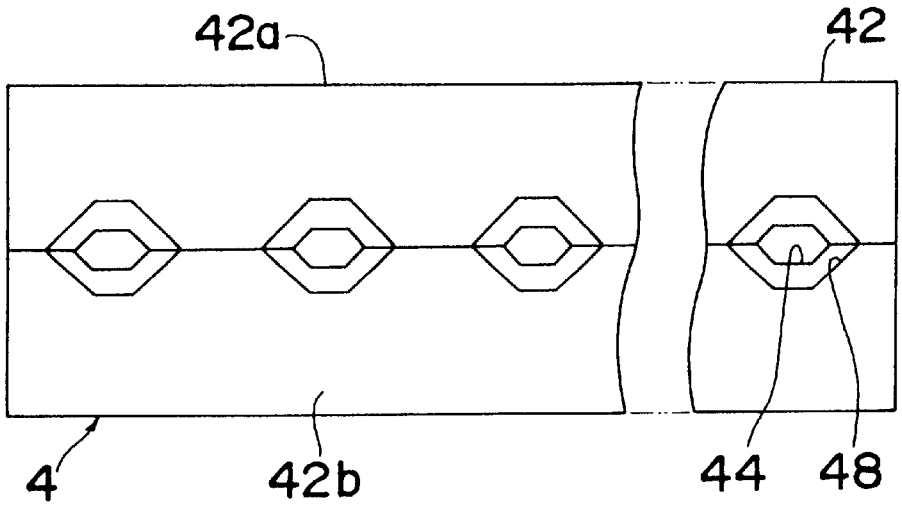
FIG. 5 is a bottom view of the nozzle of the first embodiment.

When air and the liquid are supplied to the nozzle 4 having the above construction with a controlled flow rate and pressure, as shown in FIG. 4, an air flow 21 is formed which externally surrounds in a cylindrical shape a linear liquid flow 22 flowing downward from the small holes 44. This liquid flow 22 is incessantly discharged as guided by the air flow 21 even though the amount of supply is small.

Operation of the liquid coating apparatus 1 of the third embodiment as constructed above will be described next.

When the glass panel section 2 of the cathode ray tube of the object to be coated is mounted to the tube support section 3 and the tube support section 3 is mounted to the rotational drive section 10 so that its lengthwise direction extends in the Y-direction, the valve 35 is opened and the valve 36 is closed. By this operation, the liquid that has circulated through the circulation hoses 31 and 32 and the liquid reserving section 43 inside the nozzle 4 is supplied from the tank 34 to the nozzle 4 via the circulation hose 31. Further, a pressurized air is supplied from the air pressure source 88 to the nozzle 4. The pressurized air is introduced from the air hose 30 via the air inlet to the gas reserving section 46, where the air expands or flows in the X-direction and is guided to the gas passage 49. The air guided to the gas passage 49 is formed into a layer flow air 21 or flows as a layer while passing through the passage and while discharged from the small holes 48 which serve as the outer discharge section.

On the other hand, the liquid supplied from the tank 34 via the circulation hose 31 by the circulation pump 33 is reserved in the liquid reserving section 43 via the liquid inlet and then expands or flows in the X-direction. Then, the liquid is drawn off or is expelled through the small holes 44 which serve as the inner discharge section by the air of the layer flow, and the linear liquid 22 is discharged downward through the small holes 48 along the air. It is to be noted that the flow rate in this stage differs depending on the size of the cathode ray tube 2, and for example is approximately 200 to 500 cc/min.

Figure 18:
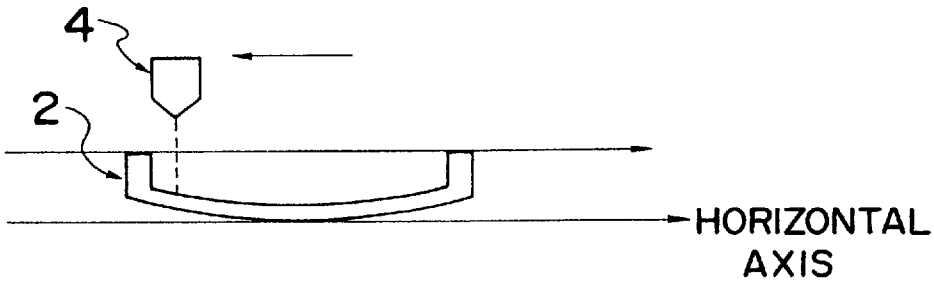
FIG. 18 is an explanatory view showing condition of a glass panel when coating is carried out the nozzle of an embodiment of the present invention.
Figure 19:
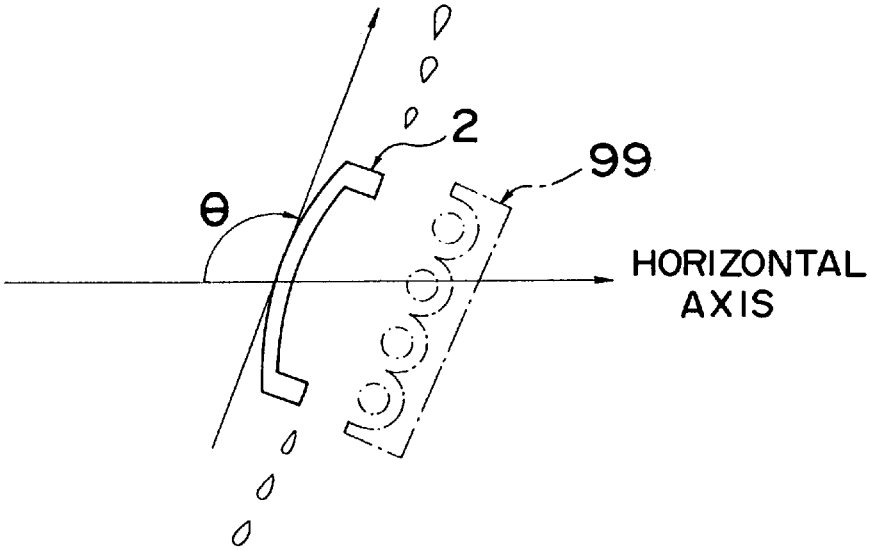
FIG. 19 is an explanatory view showing a condition of a glass panel when superfluous liquid discharging and dry operations are carried out in an embodiment of the present invention.

When the discharge of air and the liquid is started, the nozzle 4 is moved in the Y-direction with the movement of the driving frame 52 in the Y-direction through rotation of the ball thread shaft 51 by the driving motor 54. For example, as shown in FIG. 18, with the glass panel section 2 horizontally arranged, the nozzle 4 is moved horizontally. By moving the nozzle 4 in the Y-direction while discharging the liquid from the nozzle 4, the liquid flow 22 discharged from the nozzle 4 is coated on the glass panel section 2 of the cathode ray tube. When the coating of the liquid is completed, the tube support section 3 is rotated at a speed of 40 to 50 rpm by the rotational drive section 10, thereby drying the liquid with a heater 99 as shown in FIG. 19 placed on the glass panel section 2 while suppressing the flow of the liquid into the center portion, resulting in the formation of a phosphor film. Then, a phosphor layer is formed in the desired position by the known photolithographic method and thereafter this process is repeated three times in all, so that phosphor layers of the three colors of red, blue and green are formed, for example, in a matrix form in the desired position on the glass panel section 2.

In this case, the linear liquid 22 of a uniform thickness is discharged onto the glass panel section 2 so that it flows along the gas 21 discharged substantially in the form of a layer flow. Therefore, merely by moving the nozzle 4 relative to the glass panel section 2, the liquid can be coated on the glass panel section 2 while maintaining a constant film thickness. Therefore, by adjusting the amount of discharge of the liquid, a uniform thin coating film having little coating nonuniformity can be formed in a short time while suppressing the consumption of the liquid. Furthermore, since the flow rate is relatively small, the liquid forms no bubbles even when it is put in contact with the glass panel section 2. Furthermore, since the length of the line of the small holes 44 and 48 is longer than the width of the glass panel section 2 of the cathode ray tube, the liquid can be coated in one pass.

(Fourth Embodiment)

A liquid coating apparatus according to a fourth embodiment of the present invention is equivalent of the liquid coating of the third embodiment except that nozzle 40 (FIGS. 11 and 12) of the second embodiment is used in place of the nozzle 4 of the first embodiment.

When air and the liquid are supplied to the nozzle 40 of the second embodiment with a controlled flow rate and pressure, a flat plate-shaped air flow of a layer flow is discharged from the slits 148*a* and 148*b*, and a linear liquid flow is discharged from the small holes 44 along the air. This liquid flow is incessantly discharged as guided by the air even though the amount of supply is small.

(Fifth Embodiment)

A liquid coating apparatus according to a fifth embodiment of the present invention is based on the liquid coating apparatus of the third embodiment and in which the nozzle 4 is arranged so that the lengthwise direction of the nozzle 4 is inclined relative to the longitudinal direction or the lateral direction of the object to be coated in the horizontal plane. In this state the nozzle 4 is moved parallel to the longitudinal direction or the lateral direction of the object to be coated. By appropriately changing the angle of inclination of the nozzle 4, the distance between the parallel lines of the linear liquid flow drawn on the object to be coated can be adjusted.

(Sixth Embodiment)

A liquid coating apparatus according to a sixth embodiment of the present invention is based on the liquid coating apparatus of the fourth embodiment and in which the nozzle 40 is arranged so that the lengthwise direction of the nozzle 40 is inclined relative to the longitudinal direction or the lateral direction of the object to be coated in the horizontal plane, and in this state, the nozzle 40 is moved parallel to the longitudinal direction or the lateral direction of the object to be coated. By appropriately changing the angle of inclination of the nozzle 40, the width of a coating film drawn by a curtain-shaped liquid flow on the object to be coated can be adjusted.

(Seventh Embodiment)

In the first, third or fifth embodiment, the inner discharge section does not have to be the small holes 44 but can also be a slit having the length and width of the line of the small holes 44, and the outer discharge section does not have to be the small holes 48 but can also be a slit having the length and width of the line of the small holes 48. In this case, the curtain-shaped liquid flow discharged from the inner discharge section flows downward through the outer discharge section and a curtain-shaped gas flow that externally surrounds this liquid flow flows downward from the outer discharge section.

(Eighth Embodiment)

In the first, second, third, fourth, fifth, sixth or seventh embodiment, a temperature adjusting means (means for adjusting the temperature) for heating or cooling the liquid in the liquid reserving section 43 of the first block 41 can be provided in the liquid reserving section 43 or on the external surface of the liquid reserving section 43 of the first block 41. As the temperature adjusting means, for example, an instrument such as a heater for performing only heating, an instrument such as a Peltier device capable of performing heating and cooling, an instrument such as a chiller for performing only cooling, or an instrument provided with a piping for flowing a or conveying a heating medium or a cooling medium inside a block and a means for circulating the heating medium or the cooling medium through this piping can be used. By heating or cooling the liquid by the temperature adjusting means according to the rise and fall of the environmental temperature at which the nozzle is used, the viscosity of the liquid can be kept constant, thereby allowing the amount of discharge to be kept constant.

(Ninth Embodiment)

In the first, second, third, fourth, fifth, sixth seventh or eighth embodiment, a removal means for removing an object (such as a solidified resin material, particles of a pigment or the like, coagulated material of the particles or the like) that is narrowing or clogging the inner discharge section resulting in the inner discharge section being stuffed up can be provided inside or on the external surface of the liquid reserving section of the first block 41. The removal means can be a supersonic generator or a supersonic transmitting means (e.g., a rod-shaped member) for transmitting a supersonic wave from a supersonic generator placed outside the nozzle to the first block. By operating the removal means while the liquid is being discharged, the inner discharge section can be prevented from being narrowed or clogged. Further, by operating the removal means while the discharge of the liquid is stopped, the small holes or the slit that has been narrowed or clogged can be cleaned to be restored to the original state.

(Tenth Embodiment)

In the first, second, third, fourth, fifth, sixth seventh, eighth or ninth embodiment, by making each of the liquid reserving section 43 and the gas reserving sections 46 to have a shape such that the sectional area gradually increases from one end side to the other end side in the lengthwise direction of the nozzle 4 (or 40), the liquid and gas can be supplied from the side of the smaller sectional area of the liquid reserving section 43 and of the gas reserving sections 46, respectively. With this arrangement, the liquid and gas in the liquid reserving section 43 and the gas reserving sections 46 are allowed to have a small pressure difference in the lengthwise direction of the nozzle 4 (or 40), thereby allowing the amounts of discharge of the liquid and gas to be uniformed.

(Eleventh Embodiment)

Figure 15:
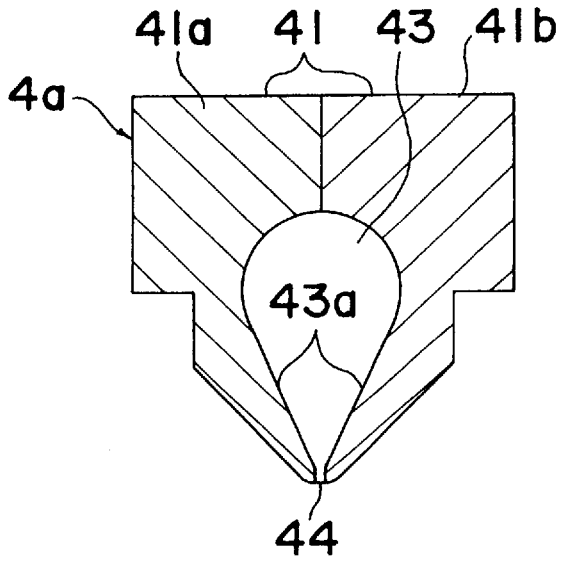
FIG. 15 is a sectional view of a nozzle of an eleventh embodiment.
Figure 16:
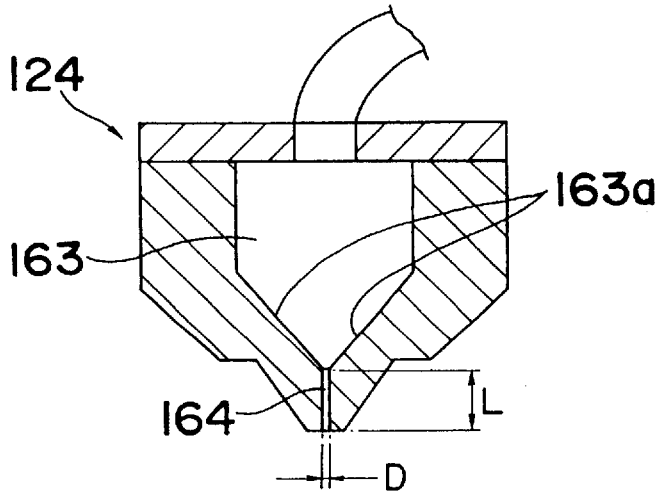
FIG. 16 is a sectional view of a nozzle of a modification of the eleventh embodiment.
Figure 17:
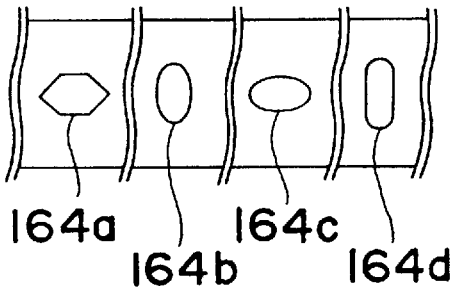
FIG. 17 is a bottom view of small holes of the nozzle according to modifications.

In the eleventh embodiment, the nozzle 4 of the first embodiment is allowed to be provided without a second block 42 (FIG. 15). A nozzle 4*a* according to the eleventh embodiment has a simplified structure, and by increasing the pressure of the liquid inside the liquid reserving section 43 so that it is greater than that of the first embodiment, the liquid can be discharged without any gas flow, allowing a linear liquid flow to flow downward onto the object to be coated. As a more actual example, FIG. 16 shows a modification of the nozzle 4 of FIG. 15 wherein curved surfaces thereof are reduced and the nozzle is comprised of planar surfaces. A liquid reserving section 163, an inclined surface 163*a*, and small holes 164 of a nozzle 124 in FIG. 16 correspond to the liquid reserving section 43, the inclined surface 43*a*, and the small holes 44, respectively. Various modifications of the small holes 44 are shown in FIG. 17. The numeral 164*a* denotes a laterally elongated hexagonal hole, 164*b* a circular hole, 164*c* a laterally elongated ellipse hole, and 164*d* a longitudinally elongated ellipse hole.

(Twelfth Embodiment)

In the second, third, fourth, fifth, sixth seventh, eighth, ninth or tenth embodiment, the nozzle 4*a* of the eleventh embodiment is employed in place of the nozzle 4 of the first embodiment.

By using the liquid coating nozzle and the liquid coating method and apparatus using this nozzle of the present invention, a process for coating at least one of: a patterning resist (e.g., polyvinyl alcohol (PVA), poly vinylpyrrolidone (PVP)) for constituting a phosphor layer forming aperture; a black inorganic pigment containing resin solution (e.g., a resin solution in which a black pigment such as carbon black is dispersed) for constituting a black matrix; and a phosphor suspension (e.g., a graphite liquid containing phosphors of green, blue and red) for constituting the phosphor layer, on the rear surface of the glass panel of the cathode ray tube can be performed to allow the cathode ray tube to be manufactured. The coated patterning resist is processed by the known exposure method, thereby forming a pattern such as temporary dots which will be the phosphor layer forming aperture in the desired position. The obtained pattern has the advantage that they are thinner and more uniform than those coated with the resist by using the conventional nozzle and the conventional liquid coating method and apparatus, thereby suppressing the color irregularity and improving the white balance. The black colorant containing liquid coated on the rear surface of the glass panel section on which the pattern is formed is processed by the known developing method for the removal of the resist at the pattern, thereby forming a black matrix (also called the black stripe) around the portions where the pattern has existed (the portions becoming the phosphor layer forming aperture). In regard to the obtained black matrix, an area to be surrounded by the black matrix is uniformed in size in comparison with the one coated with the black colorant containing liquid by using the conventional nozzle and the conventional liquid coating method and apparatus. The phosphor containing liquid is coated on the rear surface of the glass panel section on which the black matrix has been formed, thereby forming a phosphor layer in the areas surrounded by the black matrix (phosphor layer forming aperture) by the known photolithographic method. This phosphor layer formation is repeated three times in all in the order of green, blue and red, the phosphor layers of the three colors of green, blue and red are formed in the areas surrounded by the black matrix on the rear surface of the glass panel section. Each of the obtained phosphor layers is uniform in thickness in comparison with the one coated with the liquid by using the conventional nozzle and the conventional liquid coating method and apparatus. Subsequently, a cathode ray tube can be obtained by the known cathode ray tube assembling method. The obtained cathode ray tube is totally bright and free from luminance nonuniformity or has a good white balance free from color irregularity in comparison with the one coated with the resist, the black colorant containing liquid or the phosphor containing liquid by using the conventional nozzle and the conventional liquid coating method and apparatus. Furthermore, the coating process is reduced to one half to one third (in time and the length of the line) of that of the conventional one.

Figure 20:
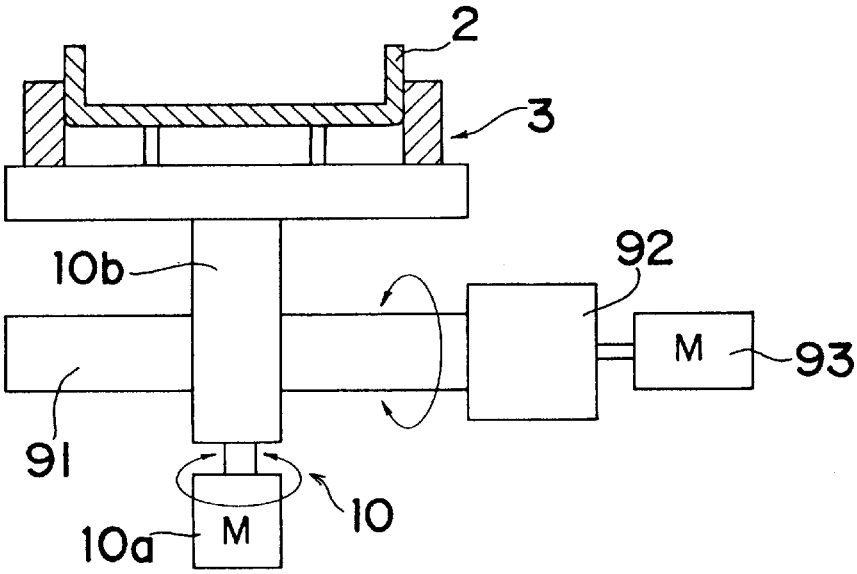
FIG. 20 is a schematic view showing a tilting mechanism and a rotating mechanism of the glass panel.
Figure 21:
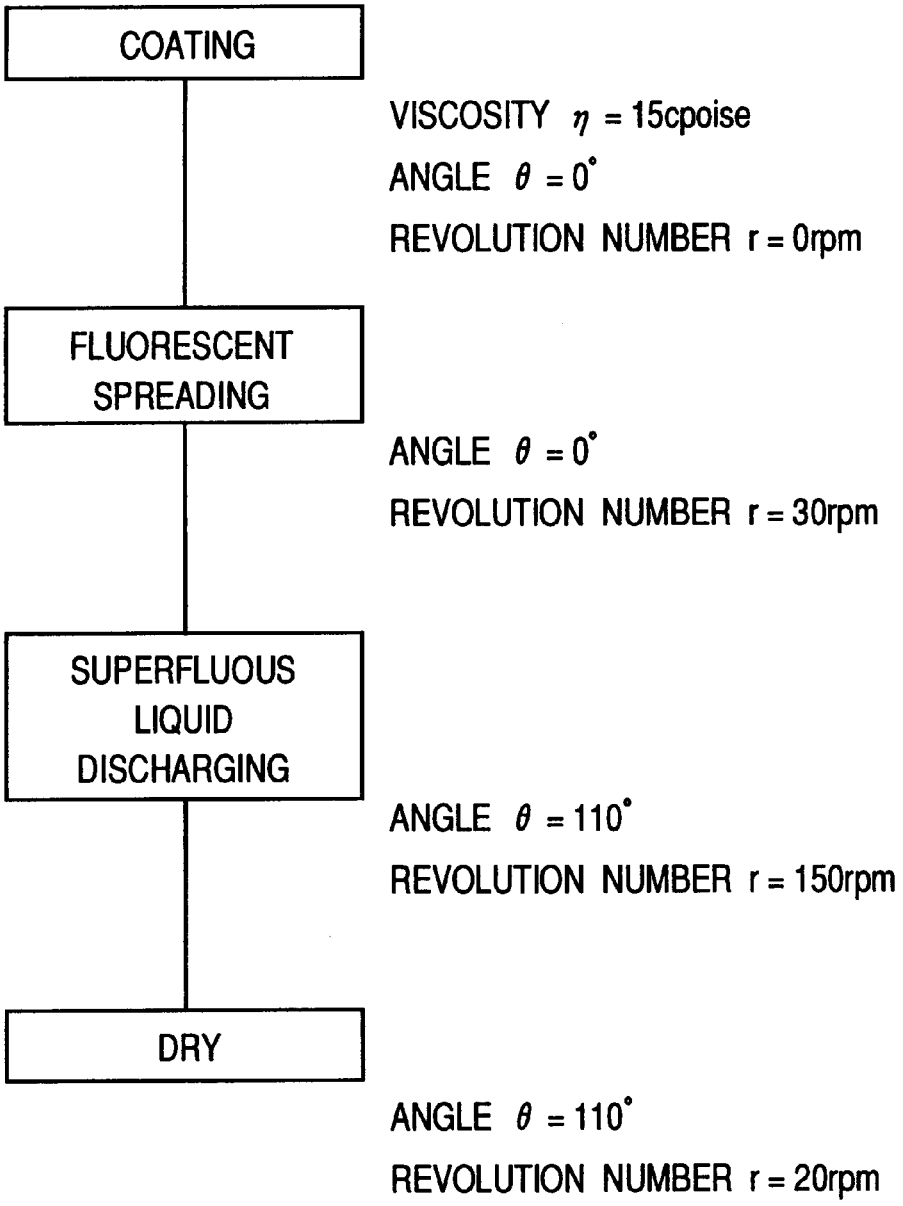
FIG. 21 is a flow chart of coating, phosphor spreading, superfluous liquid discharging, and dry processes by means of the nozzle of an embodiment of the present invention.

FIG. 20 shows a rotating and a tilting mechanisms for rotating and tilting the tube support section 3 which are applicable to the embodiments described above and 20 below. As one example of the rotating mechanism, the rotational drive section 10 for rotating the tube support section 3 supporting the glass panel 2 is comprised of a motor 10*a*, and a rotary shaft 10*b* rotated by the motor 10*a* and rotating the tube support section 3. As one example of the tilting mechanism for tilting the tube support section 3, the tilting mechanism is comprised of a tilting shaft 91 rotatably supporting the rotary shaft 10*b*, a drive motor 93 for rotating the tilting shaft 91 at desired angles to tilt the support section 3, and a gear box 92 arranged between the drive motor 93 and the tilting shaft 91. According to these arrangements, as shown in FIG. 21, for example, the coating process for coating a phosphor containing liquid (15 centipoise-viscosity) on the glass panel 2 by the nozzle is carried out in a condition where the glass panel 2 is arranged horizontally without rotating and tilting the glass panel 2 as shown in FIG. 18. In the phosphor spreading process, the glass panel 2 is rotated at 30 rpm by the rotational drive section 10 without tilting the glass panel 2 with respect to the horizonal direction to spread the liquid on the glass panel 2. Thereafter, in the superfluous liquid discharging process, as shown in FIG. 19, with the glass panel 2 tilted at $\theta=110°$ with respect to the horizonal direction by the tilting mechanism, the glass panel 2 is rotated at 150 rpm by the rotational drive section 10 so that a superfluous liquid is shaken off of and outside of the glass panel. Thereafter, as shown in FIG. 19, with the glass panel 2 tilted at $\theta=110°$ with respect to the horizonal direction by the tilting mechanism, the glass panel 2 is rotated at 20 rpm by the rotational drive section 10 to dry the glass panel 2 by the heater 99.

The liquid coating nozzle of the embodiments of the present invention comprises the first block which internally has the liquid reserving section that extends in its longitudinal direction and has the inner discharge section formed in the longitudinal direction at the bottom portion the inner discharge of the liquid reserving section. The inner discharge section is comprised of a number of small holes or a slit. The present invention further comprises the second block which has the inner space defining the gas reserving section that extends in the longitudinal direction outside the first block and the outer discharge section formed in the longitudinal direction at the bottom portion of the inner space. The outer discharge section is comprised of a number of small holes or a slit. Therefore, the liquid reserving section and the gas reserving section can be made large, the pressure difference between the one end side and the other end side in the longitudinal direction of each of the liquid reserving section and the gas reserving section can be reduced, and the amount of discharge from the inner and outer discharge sections can be made uniform in the longitudinal direction. Therefore, the liquid in the nozzle is discharged from the inner discharge section and the gas in the gas reserving section is discharged from the outer discharge section, thereby forming a gas flow that externally surrounds a linear or curtain-shaped liquid flow that flows downward from the inner discharge section. Therefore, the liquid flow flows straightly downward without deviating in the moving direction of the nozzle to reach the surface of the object to be coated without nonuniformity. When the inner discharge section and the outer discharge section are small holes, a gas flow that cylindrically surrounds the linear liquid flow is formed, and therefore, the liquid flow tends to flow straightly downward without deviating in the moving direction or in lateral direction of the nozzle.

According to the liquid coating nozzle of the embodiments of the invention, the first block and the second block are each comprised of bisected bodies divided by the vertical plane that extends in the longitudinal direction through the widthwise center of the inner discharge section. Therefore, the nozzle can be easily disassembled and cleaned when trouble, such as the clogging of the nozzle holes occurs, so that a stable discharge can be easily restored.

According to the liquid coating nozzle of the embodiments of the invention, the shape of each of the small holes constituting the inner discharge section and the outer discharge section is an elongated hexagon. Therefore, each of the liquid flow and the gas flow flows straightly downward as a turning flow, so that they hardly deviate sideways.

According to the liquid coating nozzle of the embodiments of the invention, the liquid reserving section has the inclined surfaces at the bottom of which the inner discharge section is positioned. Therefore, even when the particles containing phosphor particles are precipitated while the liquid is staying in the liquid reserving section, the liquid falls sliding along the inclined surfaces to be discharged from the discharge section without staying in the liquid reserving section, so that it hardly causes color irregularity.

According to the liquid coating nozzle of the embodiments of the invention, the sectional area of the gas reserving section is made as large as possible so long as the required strength is maintained. Therefore, the strength of the first block is assured and the gas pressure difference between the one end side and the other end side in the lengthwise direction in the gas reserving section is reduced, so that the gas flow is stabilized.

The liquid coating nozzle of the embodiments of the invention comprises the block which internally has the liquid reserving section that extends in its longitudinal direction and has the discharge section formed in the longitudinal direction at the bottom portion of the liquid reserving section. The discharge section is comprised of a number of small holes or a slit. Therefore, the liquid reserving section can be made large, the pressure difference between the one end side and the other end side in the longitudinal direction of the liquid reserving section can be reduced, and the amount of discharge from the discharge section can be uniformed in the longitudinal direction. Therefore, the liquid in the nozzle is discharged from the discharge section, so that the liquid tends to flow straightly downward in the form of a linear or curtain-shaped liquid flow. Therefore, the discharged liquid can reach the surface of the object to be coated uniformly. When the discharge section is comprised of small holes, a linear liquid flow is formed and tends to flow straightly downward.

The liquid coating nozzle manufacturing method of the embodiments of the invention is the method for manufacturing the nozzle of the embodiments of the invention in which the first block and the second block are each comprised of the bisected bodies divided by the vertical plane that extends in the longitudinal direction through the widthwise center of the inner discharge section. The inner discharge section and/or the outer discharge section is comprised of a number of small holes, whereby processing or forming of the small holes is performed by positioning the two bisected bodies which have been preparatorily processed with the groove-shaped space that serves as the liquid reserving section and/or the gas reserving section so that the opening planes of the groove-shaped spaces define an identical plane while concurrently cutting small grooves for constituting the small holes of both the bisected bodies. Therefore, a nozzle having the inner discharge section and/or the outer discharge section each comprised of a number of accurate small holes can be efficiently manufactured.

According to the liquid coating method and the liquid coating apparatus of the embodiments of the invention, the outer discharge section of the nozzle of the embodiments of the invention is made to face the object to be coated, and at least one of the object to be coated and the nozzle is moved relative to the other in the direction that intersects the longitudinal (or normally vertical) direction when the liquid flow is discharged in a linear or curtain-like shape while discharging the gas flow toward the object to be coated through the outer discharge section. Therefore, by adjusting the amount of discharge of the liquid, a uniform thin coating film having reduced coating nonuniformity can be formed in a short time while suppressing the consumption of the liquid.

According to the liquid coating method and the liquid coating apparatus of the embodiments of the invention, the discharge section of the nozzle of the embodiments of the invention is made to face the object to be coated and at least one of the object to be coated and the nozzle is moved relative to the other in the direction that intersects the longitudinal (or normally vertical) direction when the liquid flow is discharged in a linear or curtain-like shape toward the object to be coated through the discharge section. Therefore, by adjusting the amount of discharge of the liquid by the liquid pressure in the liquid reserving section, a uniform thin coating film having reduced coating nonuniformity can be formed in a short time while suppressing the consumption of the liquid.

According to the liquid coating apparatus of the embodiments of the invention, they are provided with the liquid circulating passage for supplying in a circulating manner the liquid to the liquid reserving section as well as the opening and closing member for opening and closing the liquid circulating passage. With this arrangement, the circulation of the liquid can be effected or stopped. Therefore, the circulation of the liquid can be stopped while the liquid is being discharged thereby allowing the pressure to be stabilized, and the circulation of the liquid can be effected when the discharging of the liquid is stopped thereby preventing the precipitation of the particles.

According to the cathode ray tube of the embodiments of the invention, the phosphor is coated on the rear surface of the glass panel section by the liquid coating method of the embodiments. Therefore, the thickness of the phosphor layer is uniform, so that color irregularity is eliminated and a good white balance is achieved.

According to the cathode ray tube of the embodiments of the invention, the phosphor is coated on the rear surface of the glass panel section by the liquid coating apparatus of the embodiments. Therefore, the thickness of the phosphor layer is uniform, so that color irregularity is eliminated and a good white balance is achieved.

The cathode ray tube manufacturing method of the embodiments of the invention includes a process of coating, as coating materials for phosphor screen process, at least one of a pre-coating liquid for pre-coating to improve adhesive property and wettability of a coating liquid, patterning resist for forming phosphor forming apertures, a graphite liquid for forming a black matrix, a phosphor suspension, and a lacquer liquid for filming, on the inner surface of the glass panel of the cathode ray tube by using the nozzle of the embodiments. For this purpose, for example, a cathode ray tube in which there is to be no difference between the center portion and the peripheral portion of the object to be coated with respect to the size of the phosphor layer forming aperture thereby achieving a uniformity (when the patterning resist is used), and/or no color irregularity is generated on the black matrix thereby improving the screen resolution (when the black colorant containing liquid for constituting the black matrix is coated), and/or the thickness of the phosphor layer is uniformed thereby achieving a good white balance and high luminance free from color irregularity (when the phosphor suspension for constituting the black matrix is coated) can be manufactured.

In the embodiments, as one example where the thickness of the phosphor layer is more uniform than the layer formed by the conventional one, in the conventional coating method, the center portion of a glass panel is too while the four corner portions (peripheral portions) thereof are 70 to 80 20 in rate which is less than that of the center portion. On the other hand, in one embodiment, the center portion of a glass panel is 100 while the four corner portions thereof can be 95 to 100 in rate which is substantially equal to that of the center portion. In some cases, taking into account a tendency that the peripheral portion is darker than the center portion of a cathode ray tube, the thickness of the four corner portions can be 105 to 110 in rate which is thicker than that of the center portion.

Other embodiments of the present invention will be described schematically.

A liquid coating nozzle according to another embodiment of the present invention is characterized in that a plurality of discharge holes are arranged linearly, and when the discharge hole has a length D in a nozzle sweep direction and a length d in a direction perpendicular to the nozzle sweep direction and a liquid guiding section inside the nozzle has a length L, a relation of $1<L/D\leqq 10$ is held, and if necessary, $D>d$.

According to the above-described nozzle, the direction in which a coating liquid is discharged can be compulsorily regulated in the nozzle sweep direction. With this arrangement, a sidewise spattering phenomenon can be removed which is a phenomenon where the liquid is discharged in a direction perpendicular to the nozzle sweep direction.

A cathode ray tube manufacturing method according to an embodiment of the present invention, is characterized in that a liquid coating nozzle is used in which a plurality of discharge holes are arranged linearly, when the discharge hole has a length D in a nozzle sweep direction and a length d in a direction perpendicular to the nozzle sweep direction and a liquid guiding section inside the nozzle has a length L, a relation of $1<L/D\leqq 10$ is held, and if necessary, $D>d$, the method comprising: sweeping the coating nozzle either in a direction of a shorter side or in a direction of a longer side of a glass panel, for example, the glass panel of a cathode ray tube that is in a standstill; and thereby linearly coating the coating materials for phosphor screen process to on a phosphor forming section (screen area) of the glass panel.

According to the manufacturing method, the panel front surface is preferably arranged substantially horizontally. The substantial parallelism relative to the horizontal axis means that when the panel front surface is a flat surface, the flat surface portion is parallel to the horizontal axis. When the panel front surface has a curvature, it means that a tangential line at the vertex of the portion of curvature is parallel to the horizontal axis.

According to the manufacturing method, in a case where, for example, a phosphor suspension (slurry) is coated in the above coating process, in additional to the above process, the method comprises a process of spreading a slurry on an entire surface of the phosphor surface forming section of the panel while making the panel have a glass panel rotating speed of 30 to 60 rpm; and a process of discharging a superfluous slurry while setting the glass panel rotating speed at 50 to 150 rpm and setting a glass panel tilt angle symbol at 95 to 115 degrees relative to the horizontal axis; and a process of drying a phosphor film while setting the glass panel rotating speed at 10 to 150 rpm, the processes being sequential in the order of the coating process, the spreading process, the discharging process, and the drying process, preferably.

According to the manufacturing method, a phosphor surface with a coating pattern that has a uniform quality can be implemented at a higher level, and a high-luminance cathode ray tube can be supplied.

According to the manufacturing method, it is preferable that the phosphor surface forming section of the panel has a completely flat shape. By the method, a good phosphor surface can be formed in the completely flat shaped panel that can prevent an irregular reflection due to external light.

These embodiments are specifically described based on the drawings as follows.

Figure 22A:
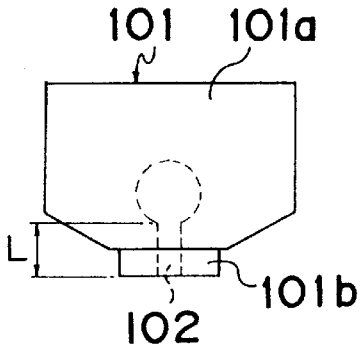
FIGS. 22A, 22B, and 22C are a front view, a bottom view, and a side view of the coating nozzle of a thirteenth embodiment of the present invention.
Figure 22C:
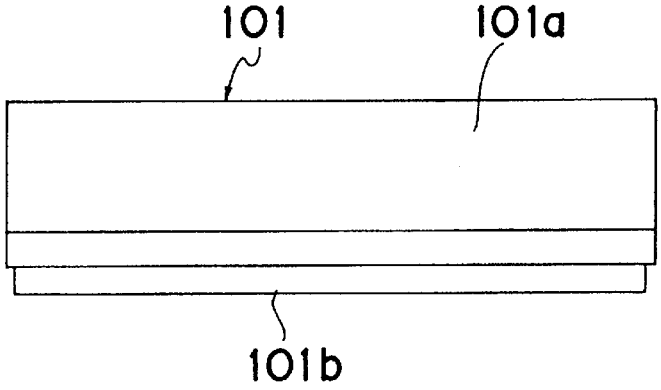
Figure 22B:
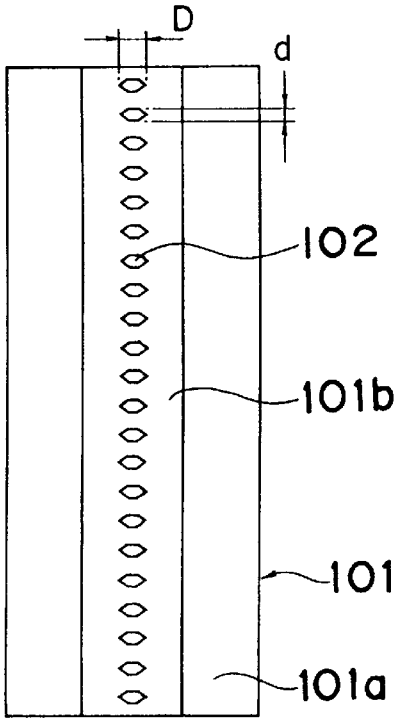

A thirteenth embodiment of the present invention will be described below with reference to the drawings. FIGS. 22A, 22B, and 22C show a view of three sides of the coating nozzle of the thirteenth embodiment of the present invention. In FIGS. 22A, 22B, and 22C, 101 denotes a coating nozzle, a coating nozzle body and 101*b* a discharge section. The reference numeral 102 denotes discharge holes arranged linearly at the discharge section. A slurry is coated linearly on a glass panel inner space through the discharge holes 102. Further, L denotes the length of a discharge liquid guiding section, D denotes the length of the discharge hole in the direction of sweep of the nozzle, and d denotes the length of the discharge hole in the widthwise direction. The lengths L, D and d satisfy the relations of the following two expressions.

$$D>d$$

$$1<L/D\leqq 10$$

By specifying the lengths L, D and d as expressed by the above relational expressions, the direction in which a coating liquid is discharged can be compulsorily regulated in the nozzle sweep direction. With this arrangement, a sidewise spattering phenomenon can be avoided. The sidewise spattering phenomenon is the phenomenon where the liquid is discharged in a direction perpendicular to the nozzle sweep direction.

When the aforementioned relational expressions are not satisfied, or, for example, when $D<d$, in some cases, it is possible that the discharge of liquid in the sweep direction is regulated, so that the bending of the liquid in the widthwise direction is disadvantageously promoted. When $1\geqq L/D$, the liquid discharging state depends significantly on the shape of the discharge hole. When $L/D>10$, a nozzle processing accuracy such as the surface finishing of the discharge liquid guiding section eventually influences the discharge of liquid. For the above reasons, the discharge of liquid is suppressed depending on the processing accuracy. When the pressing force for pressing out the liquid from the nozzle is too large, it is necessary to provide a pump with a larger capacity. Therefore, in practical use, it is preferable that $3\leqq L/D\leqq 8$.

In regard to the size of the discharge hole and a distance between adjacent holes, they are preferably as large as possible taking the prevention of plugging and the convenience of maintenance into consideration. It is to be noted that they are required to be adjusted depending on the size of the cathode ray tube to be manufactured.

The construction of the thirteenth embodiment can be applied to the nozzle in FIG. 16 and the nozzles of the embodiments.

Figure 23:
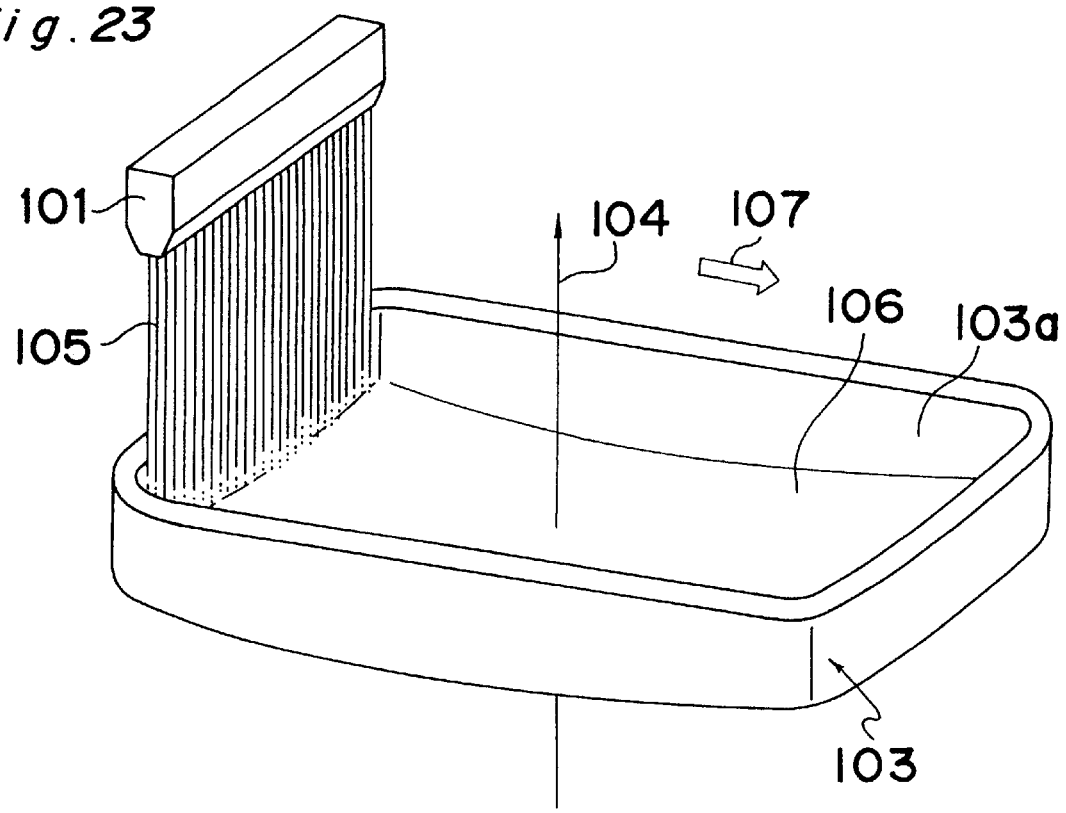
FIG. 23 is a schematic view showing an embodiment of a slurry coating method of a fourteenth embodiment of the present invention.

FIG. 23 is a schematic view showing a slurry coating method of a fourteenth embodiment of the present invention. In FIG. 23, 103 denotes a glass panel, 104 a vertical axis, 105 a slurry and 106 a glass panel inner surface. The coating nozzle 101 is the same as the one shown in FIGS. 22A, 22B, and 22C.

In order to form a phosphor surface on the panel inner surface 106, adjustment of slurry to be coated is performed first. The adjustment of the slurry is performed by mixing, for example, a green phosphor, a polyvinyl alcohol resin, ammonium bichromate, a surface active agent, an anti-foaming agent and water. The above materials are mixed together by using a propeller type mixer and thereafter dispersed for a specified time by using a dispenser. A specified ammonium bichromate and ammonia are further incorporated into the adjusted slurry, so that the pH density of the slurry is adjusted for the provision of a coating slurry. In order to increase the adhesive force of the phosphor, the slurry may be subjected to a ball milling process.

Processes in the formation of a phosphor surface will be described independently of the coating process, the spreading process, the discharging process and the drying process.

(a) Coating Process

First, the slurry 105 adjusted as described above is coated on the panel inner surface 106 by using the coating nozzle 101 as shown in FIG. 23. On the panel inner surface 106 there has been preparatorily formed a black matrix. This coating is performed by sweeping the coating nozzle 101 in a direction indicated by an arrow 107 at a specified discharge rate and a specified sweeping speed. The glass panel 103 in this stage of coating is arranged horizontally. That is, as the nozzle 4 and the glass panel 2 in FIG. 18, the front surface of the glass panel 103 is arranged substantially parallel to the horizontal axis.

The substantial parallelism relative to the horizontal axis means that when the panel front surface is a flat surface, the flat surface portion is parallel to the horizontal axis. When the panel front surface has a curvature, it means that a tangential line at the vertex of the portion of curvature is parallel to the horizontal axis.

(b) Spreading Process

When the coating of the slurry 105 is completed, the rotating speed of the glass panel 103 (abbreviated to a glass panel rotating speed hereinafter) about the vertical axis 102 is set to 30 to 60 rpm. With this arrangement, the slurry 105 is compulsorily spread on the effective surface of the panel inner surface 106, thereby allowing the liquid to be prevented from flowing back to the center portion of the panel inner surface 106 and allowing the nonuniformity of the coating pattern between the center portion and the peripheral portion of the panel inner surface 106 to be reduced. This spreading process may be performed with the glass panel maintained substantially parallel with the horizontal axis like the above coating process. In order to promote sufficient precipitation of phosphor particles and to reduce a difference between the central portion and the peripheral portion of the glass panel in a particle filling property to a level as small as possible, the spreading process can be performed while the glass panel is properly tilted at any tilting angle of the glass panel which is not larger than 45 degrees.

The arrangement that the panel rotating speed is set to 30 to 60 rpm is for the reasons as follows. When the panel rotating speed is lower than 30 rpm, the poured slurry 105 disadvantageously gathers to the center portion coating nonuniformity. When the panel rotating speed is higher than 60 rpm, the poured slurry 105 tries to spread on the entire surface of the panel inner surface 106 with a stronger force as a consequence of the increase of the centrifugal force due to the increase of the rotating speed. For this reason, the slurry 105 intensely collides with a wall surface 103*a* of the panel inner surface 106 in the peripheral portion of the panel inner surface 106. Minute bubbles are generated due to this collision, and the bubbles are disadvantageously left on the inner surface.

(c) Discharging Process

Next, as with the glass panel 2 in FIG. 19, the panel rotating speed is increased to a rotating speed higher than that of the aforementioned coating process, and the glass panel 103 is tilted relative to the horizontal axis. With this arrangement, the slurry 105 that is superfluously left in the peripheral portion of the panel inner surface 106 is shaken off and discharged out of the glass panel 103.

In this discharging stage, the panel rotating speed is preferably 50 rpm to 150 rpm. This is for the reasons as follows. When the rotating speed is lower than 50 rpm, disadvantageously the liquid flows back onto the panel inner surface 106 from its wall surface or the boundary portion between the effective surface. Also, the wall surface of the panel inner surface 106 is smeared through the process of increasing the tilt angle of the glass panel 103 from zero degree. Conversely, when the panel rotating speed is higher than 150 rpm, a coating nonuniformity disadvantageously occurs radially from the center portion to the peripheral portion of the panel inner surface 106.

The tilt angle of the glass panel 103 is made identical to that of the drying process and is described as follows. Specifically, the angle is preferably 95 to 115 degrees relative to the horizontal axis. This is for the reasons as follows. When the tilt angle of the glass panel 103 is smaller than 95 degrees, disadvantageously a drying nonuniformity occurs in the peripheral portion of the panel inner surface 106 or the slurry 105 flows back onto the panel inner surface 106 from its wall surface. Conversely, when the tilt angle of the glass panel 103 is greater than 115 degrees, the drying nonuniformity becomes more significant.

(d) Drying Process

Next, the panel rotating speed is reduced while keeping the tilt angle of the glass panel 103 in the aforementioned discharging process. In this state, by externally heating the glass panel 103 by an infrared panel heater (such as 99 in FIG. 19), the phosphor surface is dried. In this stage, a hot blast or hot air blast may be blown on the panel inner surface 106 as needed in addition to the heating by the heater. By this operation, the time required for drying can be reduced.

The panel rotating speed is preferably as low as possible so long as the production time permits. Although generally the panel rotating speed is reduced below the rotating speed in the aforementioned discharging process, the present invention is not limited to this. Specifically, the panel rotating speed in the drying stage is preferably 10 rpm to 150 rpm. Within this range, the drying state has no problem. It is to be noted that the rotating speed is preferably made lower in the second and third coating stages for the purpose of making a better coating pattern of the slurry 105.

When too much slurry has been poured, inclusion of bubbles or the like tends to occur due to liquid spattering in the peripheral portion of the panel inner surface 106. Conversely, when too little is poured, the effective surface of the panel inner surface 106 cannot be sufficiently coated. Therefore, for example, in the case of a 41 cm glass panel 103, the amount is preferably 7 to 30 $cm^3$. It is to be noted that the present invention is not required to be limited to this in relation to the amount of discharge, the nozzle sweeping speed, the panel tilt angle and the panel rotating speed.

Through the aforementioned processes, a coating film of the green phosphor is formed on the glass panel 103. Next, the glass panel 103 is mounted with a shadow mask (not shown) and thereafter subjected to exposure to ultraviolet light and a developing process, so that a green phosphor surface is produced. Through the same processes, a blue phosphor surface and a red phosphor surface can be produced.

By subjecting the obtained phosphor surface sample to an aluminum film processing, thereafter incorporating a shadow mask, a funnel, a magnetic shield and so forth (not shown) into it, enclosing an electron gun (not shown) and discharging the gas, a complete tube is produced.

It is to be noted that the phosphor forming portion of the panel inner surface 106 preferably has a completely flat surface in the aforementioned embodiment. When using one with a completely flat surface, an irregular reflection due to external light can be prevented.

EXAMPLES

Examples of the present invention and comparative examples will be described below with reference to the drawings. In each case, a complete tube was produced by subjecting the obtained the aluminum film processing, and then incorporating a shadow mask, a funnel, a magnetic shield and so forth into it, and finally enclosing an electron gun and discharging the gas. The phosphor surface to be used in a cathode ray tube had a size of 41 cm.

Example 1

The coating nozzle used in this example 1 is the same as that of the aforementioned embodiment described with reference to FIGS. 22A, 22B, and 22C.

First, as the slurry 105 to be coated on the panel inner surface 106, the following materials were used for the adjustment of the slurry 105.

Green phosphor (produced by Nichia Kagaku Kogyou): (25% by weight)

Polyvinyl alcohol resin: (2.5% by weight)

Ammonium bichromate: (0.25% by weight)

Surface active agent: (0.03% by weight)

Anti-foaming agent: (0-02% by weight)

Water: (72.2% by weight)

The above materials were mixed together by using a propeller type mixer and thereafter dispersed for a specified time by using a dispenser. As the green phosphor, one which has a particle diameter of 4 $\mu$m and was obtained by doping a zinc sulfide with copper which serves as an activator was used. As the glass panel 103, one which has a size of 41 cm, a panel transmittance of 52% and a completely flat inner effective surface was used. The adjusted slurry 105 was further incorporated with a specified ammonium bichromate and ammonia, so that the pH density of the slurry 105 was adjusted to 8 to 9 for the provision of a coating slurry 105.

Next, the adjusted slurry 105 was coated on the panel inner surface 106 which had already been provided with a black matrix by using the coating nozzle 101 shown in FIGS. 22A, 22B, and 22C according to the method shown in FIG. 23 by a discharge amount of 25 $cm^3$ from the nozzle at a nozzle sweeping speed of 15 cm/s. Simultaneously with the aforementioned coating, the panel rotating speed was increased to 40 rpm so that the slurry 105 was spread as far as possible on the effective surface of the panel inner surface 106. Next, the phosphor particles were sufficiently precipitated with the glass panel 103 kept horizontal. In the aforementioned stage of coating, the phosphor liquid from the coating nozzle 101 was uniformly coated on the entire surface of the panel inner surface 106 without spattering sideways.

Then, the panel rotating speed was increased to 90 rpm so as to shake off the superfluous slurry 105 left in the panel peripheral portion of the panel inner surface 106 while tilting the glass panel 103 to an angle of 110 degrees relative to the horizontal axis to discharge it out of the glass panel 103. Further, the panel rotating speed was reduced to 30 rpm while keeping the tilt angle of the glass panel 103 at 110 degrees, so that the phosphor surface was dried externally by an infrared panel heater.

Subsequently, a shadow mask was mounted on the glass panel 103 coated with the green phosphor, and thereafter exposured to ultraviolet light and a developing process, so that a green phosphor surface was produced. The stripe size of the obtained green phosphor was 65 μm in the center portion and 67 μm in the peripheral portion of the panel inner surface 106. No adhesion of the green phosphor to the panel inner surface 106 was observed. Likewise, a slurry 105 in which a blue phosphor having a particle diameter of 4 μm had been suspended and was coated on the panel inner surface 106, so that a blue phosphor surface was obtained. Further, for the third color, a slurry 105 in which a red phosphor having a particle diameter of 5 μm had been suspended and was coated on the panel inner surface, so that a red phosphor surface was obtained. The stripe size of the blue phosphor was 68 μm in the center portion and 69 μm in the peripheral portion of the panel inner surface 106. The stripe size of the red phosphor was 70 μm in the center portion and 72 μm in the peripheral portion of the panel inner surface 106. The blue and red phosphors that had adhered to the surface of the green phosphor were on the order of two to three particles per length of 200 μm. Almost no red phosphor was observed to be adhered to the surface of the blue phosphor.

Example 2

According to Example 2, all the conditions were the same as those of Example 1 except for the arrangement that the panel rotating speed immediately after the pouring of the slurry 105 through the coating nozzle 101 was set to 50 rpm. The stripe size of the obtained green phosphor was 66 μm in the center portion and 69 μm in the peripheral portion of the panel inner surface 106. No adhesion of the green phosphor to the panel inner surface 106 was observed. The stripe size of the blue phosphor was 66 μm in the center portion and 68 μm in the peripheral portion of the panel inner surface 106, while the stripe size of the red phosphor was 71 μm in the center portion and 74 μm in the peripheral portion of the panel inner surface 106. The blue and red phosphors that had adhered to the surface of the green phosphor were on the order of one to two particles per length of 200 μm. Almost no red phosphor that had adhered to the surface of the blue phosphor was observed in the center portion of the panel inner surface 106, and several particles were observed in the peripheral portion of the panel inner surface 106.

Example 3

According to Example 3, all the conditions were the same as those of Example 1 except for the arrangement that the panel rotating speed in the discharging stage of the superfluous slurry 105 was set to 150 rpm. The stripe size of the obtained green phosphor was 66 μm in the center portion and 69 μm in the peripheral portion of the panel inner surface 106. Almost no adhesion of the green phosphor to the panel inner surface 106 was observed. The stripe size of the blue phosphor was 70 μm in the center portion and 71 μm in the peripheral portion of the panel inner surface 106, while the stripe size of the red phosphor was 70 μm in the center portion and 74 μm in the peripheral portion of the panel inner surface 106. The blue and red phosphors that had adhered to the surface of the green phosphor were on the order of one to two particles per length of 200 μm. Almost no red phosphor that had adhered to the surface of the blue phosphor was observed in the center portion of the panel inner surface 106, and several particles were observed in the peripheral portion of the panel inner surface 106.

Example 4

According to Example 4, all the conditions were the same as those of Example 1 except for the arrangement that the panel rotating speed in the discharging stage of the superfluous slurry 105 was set to 90 rpm and the rotating speed in the subsequent drying stage was set to 90 rpm. The stripe size of the obtained green phosphor was 67 μm in the center portion and 69 μm in the peripheral portion of the panel inner surface 106. Almost no adhesion of the green phosphor to the panel inner surface 106 was observed. The stripe size of the blue phosphor was 69 μm in the center portion and 71 μm in the peripheral portion of the panel inner surface 106, while the stripe size of the red phosphor was 70 μm in the center portion and 73 μm in the peripheral portion of the panel inner surface 106. The blue and red phosphors that had adhered to the surface of the green phosphor were on the order of one to two particles per length of 200 μm. Almost no red phosphor that had adhered to the surface of the blue phosphor was observed in the center portion of the panel inner surface 106, and several particles were observed in the peripheral portion of the panel inner surface 106.

Comparative Example 1

According to Comparative Example 1, all the conditions were the same as those of Example 1 except for the arrangement that the panel rotating speed for the precipitation of the phosphor was set to 15 rpm. The stripe size of the obtained green phosphor was 69 μm in the center portion and 66 μm in the peripheral portion of the panel inner surface 106. Adhesion of about 10 green phosphor particles to the black matrix was observed within the range in length of 200 μm on the entire surface of the panel inner surface 106.

Figure 24:
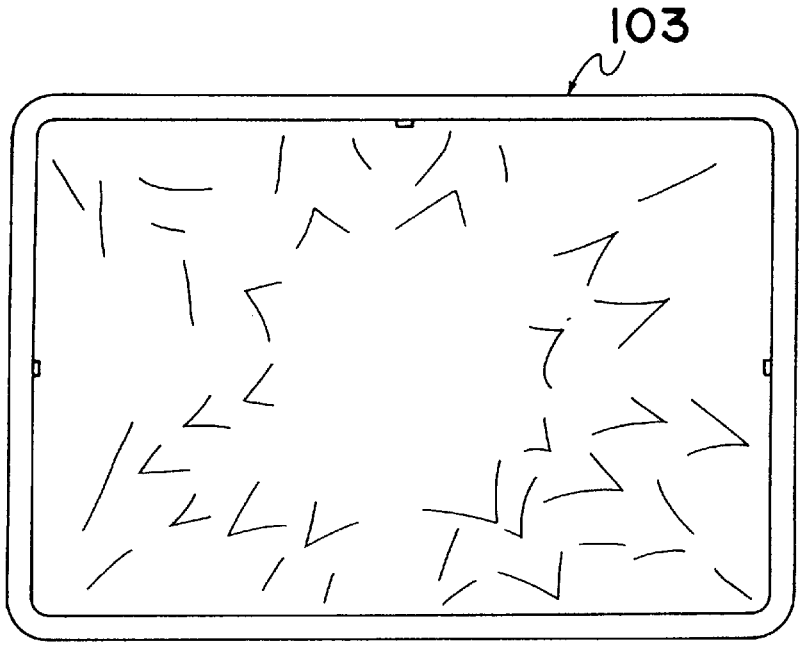
FIG. 24 is a view showing an example of a coating pattern of a slurry of a comparative example.

Furthermore, a coating nonuniformity occurring radially from the center portion to the peripheral portion of the panel inner surface 106 as shown in FIG. 24 was observed on the panel inner surface 106 after the green slurry had been dried. The stripe size of the blue phosphor was 70 μm in the center portion and 68 μm in the peripheral portion of the panel inner surface 106, while the stripe size of the red phosphor was 76 μm in the center portion and 71 μm in the peripheral portion of the panel inner surface 106. The blue and red phosphor were on the order of several particles per length of 200 μm. However, a limitless number of red phosphors were observed to be adhered to the surface of the blue phosphor on the entire surface of the panel inner surface 106.

Comparative Example 2

Figure 25A:
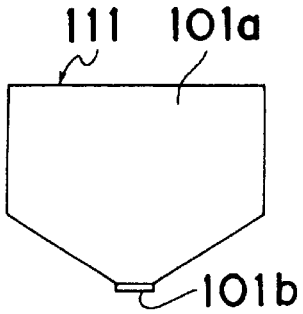
FIGS. 25A, 25B, and 25C are a front view, a bottom view, and a side view of a conventional coating nozzle.
Figure 25C:
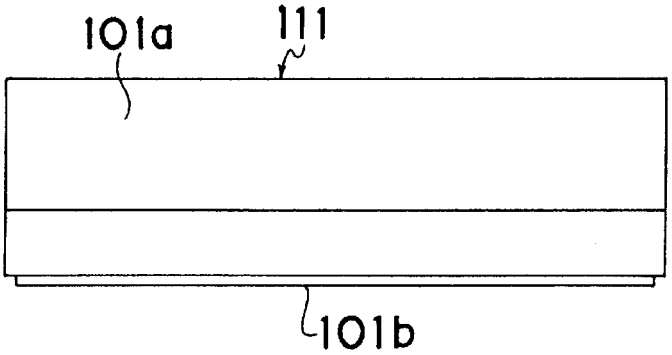
Figure 25B:
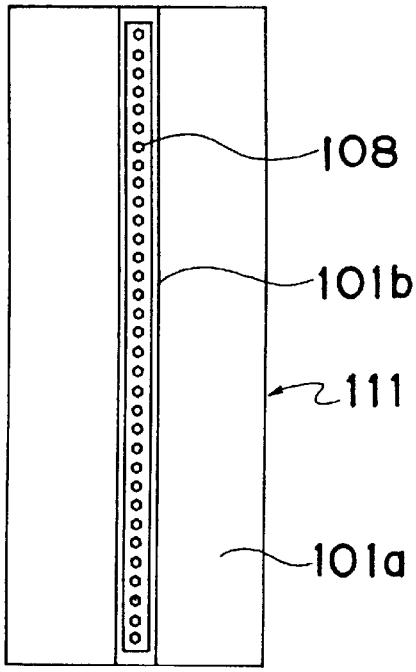
Figure 26:
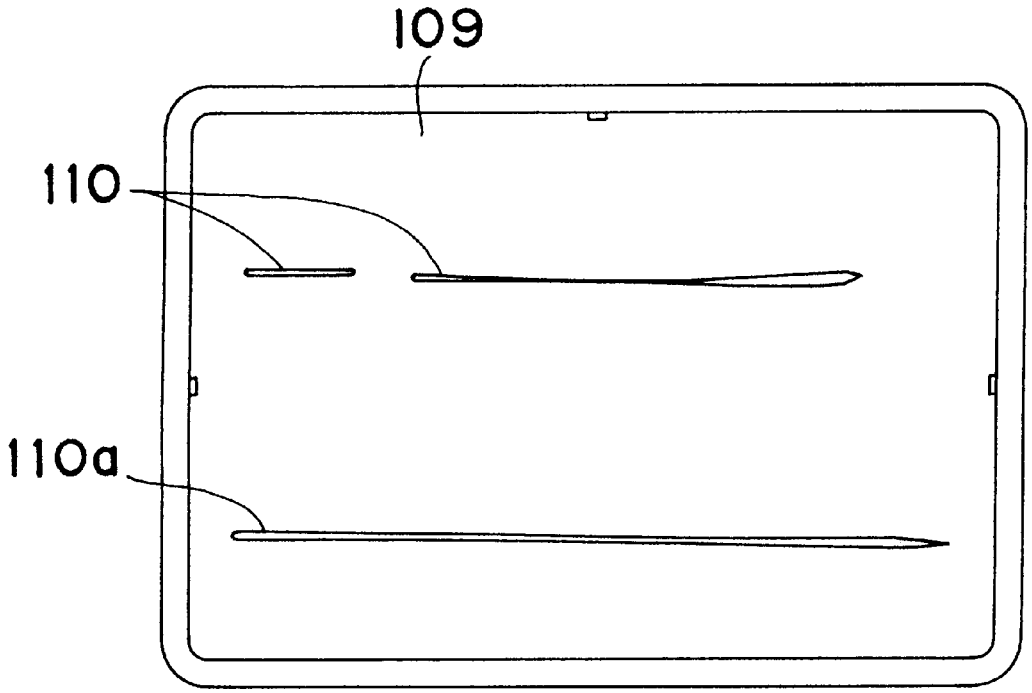
FIG. 26 is a view showing an example of a coating pattern of a slurry of a comparative example.

According to Comparative Example 2, all the conditions were the same as those of Example 1 except for the arrangement that a conventional coating nozzle 11 processed with holes as shown in FIGS. 25A, 25B, and 25C was used. The coating nozzle shown in FIGS. 25A, 25B, and 25C has round holes 108 and the relation of D>d as in the aforementioned embodiment is not satisfied. In this case, the slurry 105 discharged from the coating nozzle 111 exhibited a partial sidewise spattering phenomenon, and uncoated portions 110 and 110*a* (the reference numeral 109 denotes, a coated portion) were left on the panel inner surface 106 as shown in FIG. 26. Thus, the entire effective surface of the panel inner surface 106 was not coated with the slurry 105 even after the subsequent panel rotating process.

Comparative Example 3

According to Comparative Example 3, all the conditions were the same as those of Example 1 except for the arrangement that the conventional coating nozzle processed with the holes as shown in FIGS. 25A, 25B, and 25C was used like the Comparative Example 2 and that the panel rotating speed in the discharging stage of the superfluous slurry 105 was set to 150 rpm. A radial coating nonuniformity similar to the one as shown in FIG. 24 was observed on the panel inner surface 106.

The results of measurement and evaluation of Examples 1 through 4 and the Comparative Examples 1 through 3 are shown in the Table below.

First, evaluation of the coating pattern and phosphor contamination is shown in Table 1 below.

TABLE 1

| | Coating pattern | B, R/G | R/B | G surface |
|---|---|---|---|---|
| Example 1 | ○ | 2 to 3 | 0 | 0 |
| Example 2 | ○ | 1 to 2 | 0 | 0 |
| Example 3 | ○ | 1 to 2 | 0 | 0 |
| Example 4 | ○ | 1 to 2 | 0 | 0 |
| Comparative Example 1 | Δ | 7 to 8 | Countless | 10 |
| Comparative Example 2 | x | — | — | — |
| Comparative Example 3 | Δ | 10 to 18 | Countless | 5 to 8 |

In Table 1, the mark ○ indicates that the coating pattern is good, the mark Δ indicates that the coating pattern has a coating nonuniformity, and the mark x indicates that an uncoated portion exists. Further, B, R/G shows the contamination of the blue phosphor and the red phosphor with the green phosphor surface, R/B shows the contamination of the red phosphor with the blue phosphor surface, and the G surface indicates the contamination of the green phosphor with the panel inner surface 106. Each numeric value in the table indicates the amount of adhering particles of the other phosphors per 200 $\mu$m.

As evident from Table 1, in contrast to each of the Comparative Examples 1 through 3 which each have a defect in the coating pattern, each of Examples 1 through 4 is good.

Next, evaluation of the complete tubes is shown in Table 2 below.

TABLE 2

| | Relative luminance (%) | | | |
|---|---|---|---|---|
| | R | B | G | W |
| Example 1 | 112 | 109 | 137 | 119 |
| Example 2 | 106 | 111 | 138 | 118 |
| Example 3 | 103 | 107 | 136 | 115 |

TABLE 2-continued

| | Relative luminance (%) | | | |
|---|---|---|---|---|
| | R | B | G | W |
| Example 4 | 115 | 110 | 137 | 121 |
| Comparative Example 1 | 100 | 100 | 100 | 100 |
| Comparative Example 2 | — | — | — | — |
| Comparative Example 3 | 79 | 87 | 92 | 87 |

In Table 2, R indicates a red single-color luminance, B indicates a blue single-color luminance, G indicates a green single-color luminance and W indicates a white luminance. All the values are relative to 100% of those of Comparative Example 1. As is understood from Table 2, the luminance values of Examples 1 through 4 exceed those of Comparative Examples 1 through 3.

Although the 41 cm glass panel 103 is used in each of the Examples of the present invention, the present invention is not limited to this. For example, even in the case of another size, the present invention can be sufficiently applied by adjusting the amount of discharge of slurry 105 from the coating nozzle, the nozzle sweeping speed and so forth.

Furthermore, although the shape of the holes processed or formed in the protruding section provided at the nozzle end portion 102 of the nozzle 101 for coating the slurry 105 is hexagonal in each of the Examples of the present invention, the shape is not limited to the hexagonal shape so long as the linear configuration of the discharge of the liquid of the slurry 105 from the coating nozzle 101 can be assured.

Furthermore, although the description of the embodiments relates to the film formation by using the slurry 105, the present invention is not limited to this. A liquid used as coating material for a phosphor screen process to coat the inner surface of the glass panel of the cathode ray tube, for example, a pre-coating liquid for pre-coating to improve adhesive property and wettability of a coating liquid, a patterning resist for forming phosphor forming apertures, a graphite liquid for forming a black matrix, a phosphor suspension, and a lacquer liquid for filming can be used. Additionally, the present invention can be sufficiently applied to cases where phosphors having particles of various diameters are used and to cases where a pattern of phosphors is in a dot or strip pattern.

As described above, according to the liquid coating nozzle and cathode ray tube manufacturing method of the present invention, by using the linear coating nozzle optimizing the coating schedule of a phosphor screen process, a phosphor surface having a coating pattern with a uniform quality can be implemented at a higher level, and a high-luminance cathode ray tube can be produced. Therefore, the present invention can sufficiently adapt to the finer and larger size displays of the future, meaning that it is a very useful invention.

The entire disclosure of Japanese Applications No. 8-33391 filed on Feb. 21, 1996 and No. 8-271104 filed on Oct. 14, 1996, including the specifications, claims, drawings, and summaries is incorporated herein by reference in their entirety.

Although the present invention has been fully described in connection with the preferred embodiments thereof with reference to the accompanying drawings, it is to be noted that various changes and modifications are apparent to those skilled in the art. Such changes and modifications are to be understood as being included within the scope of the present invention as defined by the appended claims unless they depart therefrom.

We claim:

1. A nozzle for coating an object with liquid, comprising:

a first block having an inner liquid reserving section which extends in a longitudinal direction and an inner discharge section which is formed at a bottom portion of said inner liquid reserving section and which extends in the longitudinal direction, said inner discharge section having formed therein a plurality of holes or a slit so as to form an outlet of said inner discharge section; and a second block having an inner gas reserving section which extends in the longitudinal direction and an outer discharge section which is formed at a bottom portion of said inner gas reserving section and which extends in the longitudinal direction, said outer discharge section having formed therein a plurality of holes or a slit so as to form an outlet of said outer discharge section;

wherein said first block is positioned in said second block such that said outlet of said inner discharge section is further from a position where the object is to be coated than a portion of said outlet of said outer discharge section nearest said inner discharge section, so that liquid flowing from said inner liquid reserving section through said inner discharge section is surrounded by gas flowing from said inner gas reserving section through said outer discharge section.

2. The nozzle of claim 1, wherein said first block and said second block are each comprised of bisected bodies divided by a plane extending in the longitudinal direction through a center of said inner discharge section.

3. The nozzle of claim 2, wherein each hole of said plurality of holes of said inner discharge section and of said outer discharge section are elongated hexagons.

4. The nozzle of claim 2, wherein said inner liquid reserving section has an inclined surface at a bottom of which said inner discharge section is formed.

5. The nozzle of claim 1, wherein each hole of said plurality of holes of said inner discharge section and of said outer discharge section are elongated hexagons.

6. The nozzle of claim 5, wherein said liquid reserving section has an inclined surface at a bottom of which said inner discharge section is formed.

7. The nozzle of claim 1, wherein said liquid reserving section has an inclined surface at a bottom of which said inner discharge section is formed.

8. The nozzle of claim 1, wherein said first block is positioned in said second block such that the gas discharged from said inner gas reserving section initially enters the atmosphere at said portion of said outer discharge section nearest said inner discharge section.

9. A method of manufacturing a nozzle for coating an object with liquid, comprising:

positioning a first block bisected in a longitudinal direction into two halves and having an inner liquid reserving section which extends in the longitudinal direction and an inner discharge section which is formed at a bottom portion of the inner liquid reserving section, which extends in the longitudinal direction, and which is to have formed therein a plurality of holes so as to form an outlet of the inner discharge section, so that the inner discharge section of each half of the first block abuts the inner discharge section of the other half of the first block;

positioning a second block bisected in the longitudinal direction into two halves and having an inner gas reserving section which extends in the longitudinal direction and an outer discharge section which is formed at a bottom portion of the inner gas reserving section, which extends in the longitudinal direction, and which is to have formed therein a plurality of holes so as to form an outlet of the outer discharge section, so that the outer discharge section of each half of the second block abuts the outer discharge section of the other half of the second block; and forming grooves in the inner discharge section and in the outer discharge section to constitute the plurality of holes, such that after the blocks are assembled the first block is positionable in the second block such that the outlet of the inner discharge section is further from a position where the object is to be coated than a portion of the outlet of the outer discharge section nearest the inner discharge section, so that liquid flowing from the inner liquid reserving section through the inner discharge section is surrounded by gas flowing from the inner gas reserving section through the outer discharge section.

10. The method of claim 9, wherein the first block is positioned in the second block such that the gas discharged from the inner gas reserving section initially enters the atmosphere at the portion of the outer discharge section nearest the inner discharge section.

11. A method for coating an object, comprising:

discharging liquid in a linear or curtain-like shape and gas surrounding the liquid from a nozzle comprised of a first block having an inner liquid reserving section which extends in a longitudinal direction and an inner discharge section which is formed at a bottom portion of the inner liquid reserving section, which extends in the longitudinal direction, and which has formed therein a plurality of holes or a slit so as to form an outlet of the inner discharge section, and a second block having an inner gas reserving section which extends in the longitudinal direction and an outer discharge section which is formed at a bottom portion of the inner gas reserving section, which extends in the longitudinal direction, and which has formed therein a plurality of holes or a slit so as to form an outlet of the outer discharge section, wherein the first block is positioned in the second block such that the outlet of the inner discharge section is further from a position where the object is to be coated than a portion of the outlet of the outer discharge section nearest the inner discharge section; and moving the object and the nozzle relative to each other while discharging the liquid and the gas.

12. The method of claim 11, further comprising:

tilting and rotating the object to discharge superfluous liquid from the object after moving the object and the nozzle relative to each other; and drying the liquid on the object.

13. The method of claim 11, wherein the first block is positioned in the second block such that the gas discharged from the inner gas reserving section initially enters the atmosphere at the portion of the outer discharge section nearest the inner discharge section.

14. A system for coating an object with liquid, comprising:

a nozzle comprising a first block having an inner liquid reserving section which extends in a longitudinal direction and an inner discharge section which is formed at a bottom portion of said inner liquid reserving section and which extends in the longitudinal direction, said inner discharge section having formed therein a plurality of holes or a slit so as to form an outlet of said inner discharge section, and a second block having an inner gas reserving section which extends in the longitudinal direction and an outer discharge section which is formed at a bottom portion of said inner gas reserving section and which extends in the longitudinal direction, said outer discharge section having formed therein a plurality of holes or a slit so as to form an outlet of said outer discharge section, wherein said first block is positioned in said second block such that said outlet of said inner discharge section is further from a position where the object is to be coated than a portion of said outlet of said outer discharge section nearest said inner discharge section, so that liquid flowing from said inner liquid reserving section through said inner discharge section is surrounded by gas flowing from said inner gas reserving section through said outer discharge section; and a relative movement device operable to move at least one of said nozzle and the object relative to the other.

15. The system of claim 14, wherein said first block and said second block are each comprised of bisected bodies divided by a plane extending in the longitudinal direction through a center of said inner discharge section.

16. The system of claim 14, wherein each hole of said plurality of holes of said inner discharge section and of said outer discharge section are elongated hexagons.

17. The system of claim 14, wherein said inner liquid reserving section has an inclined surface at a bottom of which said inner discharge section is formed.

18. The system of claim 14, further comprising:

a liquid circulating passage operable to supply in a circulating manner liquid to said inner liquid reserving section; and an opening and closing member operable to open and close the liquid circulating passage.

19. The system of claim 18 further comprising:

a rotating mechanism operable to rotate the object, thereby discharging superfluous liquid from the object;

a tilting mechanism operable to tilt the object, thereby discharging superfluous liquid from the object; and a drying device operable to dry liquid coated on the object.

20. The system of claim 14, further comprising:

a rotating mechanism operable to rotate the object, thereby discharging superfluous liquid from the object;

a tilting mechanism operable to tilt the object, thereby discharging superfluous liquid from the object; and a drying device operable to dry liquid coated on the object.

21. The system of claim 14, wherein said first block is positioned in said second block such that the gas discharged from said inner gas reserving section initially enters the atmosphere at said portion of said outer discharge section nearest said inner discharge section.

* * * * *